United States Patent [19]

Sakai et al.

[11] Patent Number: 4,985,338

[45] Date of Patent: Jan. 15, 1991

[54] SILVER HALIDE PHOTOGRAPHIC MATERIAL

[75] Inventors: Minoru Sakai; Kazunobu Katoh; Jiro Yamaguchi; Hisashi Okada; Tomokazu Yasuda; Masaki Satake, all of Kanagawa, Japan

[73] Assignee: Fuji Photo Film Co., Ltd., Kanagawa, Japan

[21] Appl. No.: 322,456

[22] Filed: Mar. 10, 1989

[30] Foreign Application Priority Data

Mar. 10, 1988 [JP] Japan ..... 63-057303

[51] Int. Cl.[5] ..... G03C 1/34

[52] U.S. Cl. ..... 430/264; 430/627; 430/631; 430/598

[58] Field of Search ..... 430/264, 627, 631, 598

[56] References Cited

U.S. PATENT DOCUMENTS 4,199,363 4/1980 Chen ..... 430/512

4,569,905 2/1986 Mukunoki et al. ..... 430/546

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

A silver halide photographic material comprising a support having provided thereon at least one hydrophilic colloid layer, the hydrophilic colloid layer comprising polymer particles which contain hydrazine derivative.

8 Claims, No Drawings

SILVER HALIDE PHOTOGRAPHIC MATERIAL

FIELD OF THE INVENTION

This invention concerns silver halide photographic materials and, more precisely, it concerns silver halide photographic materials having fine polymer particles containing a hydrophobic hydrazine derivative dispersed therein in a stable manner.

BACKGROUND OF THE INVENTION

The inclusion of hydrazine compounds for various purposes in silver halide emulsion layers has been described, for example, by Mees on page 281 of *The Theory of the Photographic Process,* Third Edition (1966), in *Research Disclosure,* 23510 (November, 1983), and in U.S. Pat. Nos. 4,224,401, 4,243,739, 4,272,614, 4,323,643, 4,385,108 and 4,268,969. Particularly, hydrazine compounds are used in combination with internal latent image type silver halides to form direct positive images, and in combination with surface latent image type silver halides to achieve high speed and negative images having high contrast.

When hydrazine compounds are used in silver halide photographic materials for such purposes, they are preferably rendered fast to diffusion, which is to say water insoluble. Thus, the fast to diffusion hydrazine compounds do not dissolve out of the photographic material into the processing baths such that the baths do not become contaminated thereby, nor do they have any adverse effect on adjacent emulsion layers within the photographic material.

However, it is difficult to disperse such water insoluble hydrophobic hydrazine compounds in a hydrophilic silver halide emulsion in a stable manner.

Conventional methods used to disperse hydrophobic photographic additives in silver halide emulsions include methods wherein the additives are dissolved in a water miscible organic solvent such as methanol and then added to the emulsion, with the joint use of a surfactant, as required; methods wherein the additive is dissolved in a high boiling point organic solvent such as dibutyl phthalate or tricresyl phosphate and then agitated with a hydrophilic colloid to disperse the additives therein, with the conjoint use of a surfactant, as required, and wherein the resulting dispersion is then mixed with an emulsion; and methods wherein the additive is loaded onto a loadable polymer latex and then mixed with the emulsion, as disclosed, for example, in JP-B-58-35214 (the term "JP-B" as used herein means an "examined Japanese patent publication").

Other methods include those wherein, as disclosed in JP-A-61-34538, the aggregation and crystallization of the hydrazine compound in the coating liquid is prevented by mixing an essentially water insoluble hydrazine compound with the water insoluble organic compound to reduce the melting point of the mixture (the term "JP-A" as used herein means an "unexamined published Japanese patent application").

However, when hydrophobic hydrazine compounds are dissolved in a water miscible organic solvent and added to a silver halide emulsion, the hydrazine compound coagulates and crystallizes in the coating liquid following addition and prior to coating. This crystallization cannot be prevented even with the use of large quantities of surfactants. Consequently, the hydrazine compound does not have its intended effect on the silver halide grains.

Furthermore, high boiling point organic solvents are effective for the dispersion of substances such as dye forming couplers and anti-color mixing agents which react with a diffusible active species (the oxidant of a color developing agent) formed during processing in color photography. However, high boiling point organic solvents are in appropriate for the diffusion transport of substances such as the hydrazine compounds which must undergo direct reaction with the non-diffusible silver halide grains in order to provide its intended effect. That is to say, the hydrazine compound is inevitably entrained in the dispersion when an amount of dispersing agent (high boiling point organic solvent) sufficient to provide a stable dispersion of the hydrophobic hydrazine compounds is used such that the hydrazine compound is unable to undergo a direct reaction with the silver halide grains.

Furthermore, methods wherein an essentially water insoluble organic compound is mixed with a hydrazine compound to reduce the melting point of the mixture is only effective for a period of about 6 hours after the coating liquid has been prepared. This method is effective as compared to systems in which the melting point has not been reduced, but the effect is inadequate over longer periods of time. Furthermore, it is difficult to completely prevent precipitation and coagulation when the hydrazine compound is used in a large amount (i.e., an amount of $1.5\times10^{-3}$ mol or more per mol of silver). Moreover, there is a further disadvantage in that the presence of a low boiling point organic solvent causes adverse effects on the coating properties such as filter blockage at coating and ununiform coating.

SUMMARY OF THE INVENTION

Hence, the objective of this invention is to provide silver halide photographic materials in which a hydrophobic hydrazine derivative is dispersed and included into a hydrophilic colloid layer in a stable manner such that the hydrazine compound may satisfactorily act in the intended manner as described above.

A further objective of the invention is to provide a method of dispersing a hydrophobic hydrazine derivative in a coating liquid in a stable manner such that the hydrazine compound may act, as described above, in the intended manner.

The objectives of the present invention are attained by a silver halide photographic material comprising a support having provided thereon at least one hydrophilic colloid layer, the hydrophilic colloid layer comprising polymer particles which contain a hydrazine derivative.

Methods for incorporating hydrophobic hydrazine compounds in fine polymer particles include a method wherein hydrophobic substances such as lipophilic couplers are dissolved in a water miscible organic solvent, and wherein the solution thus obtained is mixed with a loadable polymer latex such that the substance is loaded onto the polymer as disclosed, for example, in U.S. Pat. No. 4,203,716 (corresponding to JP-B-58-35214), JP-B-60-56175, JP-A-54-32552, JP-A-53-126060, JP-A-53-137131, U.S. Pat. Nos. 4,201,589 and 4,199,363, West German Patent Application (OLS) No. 2,827,519, U.S. Pat. No. 4,304,769, EP 14921A, and U.S. Pat. No. 4,247,627. Furthermore, methods in which hydrophobic compounds are dissolved, emulsified and dispersed with a high boiling point organic solvent and a polymer have been disclosed, for example, in JP-A-60-140344, West German Patent Application (OLS) No. 2,830,917, U.S. Pat. No. 3,619,195, JP-B-60-18978, JP-A-51-25133 and JP-A-50-102334.

These methods are effective for the dispersion of substances which react with a diffusible active species (the oxidized form of the developing agent) formed during processing. It was thought that a hydrazine derivative in such a dispersion would inevitably be entrained in the dispersion medium (polymer) such that it would be difficult for any direct reaction to occur between the dispersed hydrazine derivative and the non-diffusible silver halide grains. Thus, a reduction in hydrazine activity was expected. Furthermore, in cases where the substance was dissolved in a high boiling point organic solvent and then emulsified and dispersed, some reduction in activity was expected. However, contrary to expectation, the method of the present invention wherein the hydrazine derivatives of the present invention are contained within fine polymer particles, provides a stable dispersion in the emulsion without a reduction in the activity of the hydrazine derivative.

Thus, a novel technique for incorporating hydrazine derivatives in silver halide photographic materials, hitherto unknown, has been discovered. The present invention is based upon this discovery.

The use of hydrazine derivatives represented by formula (I) below is preferred for use in the present invention.

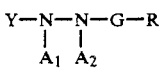

(I)

wherein Y represents an aliphatic group, an aromatic group or a heterocyclic group, $A_1$ and $A_2$ each represents a hydrogen atom or one of $A_1$ and $A_2$ represents a hydrogen atom while the other represents a sulfinic acid residue or a

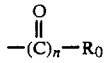

group wherein $R_0$ represents an alkyl group, an alkenyl group, an aryl group, an alkoxy group or an aryloxy group, and n represents an integer having a value of 1 or 2; R represents a hydrogen atom, an alkyl group, an aryl group, an alkoxy group, an aryloxy group, an amino group, an alkoxycarbonyl group, an aryloxycarbonyl group, a carbamoyl group, an azo group or a heterocyclic group; and G represents a carbonyl group, a sulfonyl group, a sulfoxy group, a

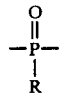

group (wherein R is defined as above) or an iminomethylene group.

In formula (I), the aliphatic groups represented by Y preferably have 1 to 30 carbon atoms, and branched or cyclic alkyl groups having 1 to 20 carbon atoms are particularly preferred. The branched alkyl groups may be cyclized so that they form saturated hetero cyclic groups containing at least one hetero atom therein. Further, these branched alkyl groups may have substituents such as an aryl group, an alkoxy group, a sulfoxy group, a sulfonamido group, and a carbonamido group.

In formula (I), the aromatic groups or heterocyclic groups represented by Y are specifically monocyclic or bicyclic aryl groups or unsaturated heterocyclic groups. Herein, the unsaturated heterocyclic group may from an hetero aryl group condensed with a monocyclic or bicyclic aryl group.

Specific examples of the aromatic groups or heterocyclic groups represented by Y include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc. Among these, those containing a benzene ring are preferred.

An aryl group is most preferred for Y.

The aryl groups or unsaturated heterocyclic groups of Y may be substituted. Typical examples of the substituents include linear chained, branched or cyclic alkyl groups (preferably having 1 to 20 carbon atoms), aralkyl groups (preferably monocyclic or bicyclic aralkyl groups having 1 to 3 carbon atoms in the alkyl moiety thereof), alkoxy groups (preferably having 1 to 20 carbon atoms), substituted amino groups (preferably amino groups substituted with an alkyl group having 1 to 20 carbon atoms), acylamino groups (preferably having 2 to 30 carbon atoms), sulfonamido groups (preferably having 1 to 30 carbon atoms), and ureido groups (preferably having 1 to 30 carbon atoms).

The alkyl groups represented by R in formula (I) are preferably those having 1 to 4 carbon atoms, and may have substituents such as halogen atoms, a cyano group, a carboxy group, a sulfo group, alkoxy groups or a phenyl group.

The aryl groups represented by R are preferably monocyclic or bicyclic aryl groups (e.g., those groups containing a benzene ring). These aryl groups may be substituted with, for example a halogen atom, an alkyl group, a cyano group, a carboxyl group, a sulfo group, etc.

The alkoxy groups represented by R are preferably those having 1 to 8 carbon atoms, and may be substituted with a halogen atom, an aryl group, etc.

The aryloxy groups represented by R are preferably monocyclic ones and may be substituted with a halogen atom, etc.

The amino groups represented by R are preferably unsubstituted groups and alkylamino or arylamino groups having 1 to 10 carbon atoms. These amino groups may be substituted with an alkyl group, a halogen atom, a cyano group, a nitro group, a carboxy group, etc.

The carbamoyl groups represented by R are preferably unsubstituted and alkylcarbamoyl or arylcarbamoyl groups having 1 to 10 carbon atoms are also preferred. These carbamoyl groups may be substituted with an alkyl group, a halogen atom, a cyano group, a carboxyl group, etc.

The alkoxycarbonyl and aryloxycarbonyl groups represented by R are preferably those having 1 to 10 carbon atoms. These groups may be substituted with an alkyl group, a halogen atom, a cyano group, a nitro group, etc.

When G is a carbonyl group, the group represented by R is preferably a hydrogen atom, an alkyl group (for example, methyl, trifluoromethyl, 3-hydroxypropyl, 3-methanesulfonamidopropyl), an aralkyl group (for example, o-hydroxybenzyl), an aryl group (for example, phenyl, 3,5-dichlorophenyl, o-methanesulfonamidophenyl, 4-methanesulfonylphenyl), and, of these, a hydrogen atom is the most desirable.

Furthermore, when G is a sulfonyl group, R is preferably an alkyl group (for example, methyl), an aralkyl group (for example, o-hydroxyphenylmethyl), an aryl group (for example, phenyl) or a substituted amino group (for example, dimethylamino).

When G is a sulfoxy group, R is preferably a cyanobenzyl group or a methylthiobenzyl group, for example.

When G is a

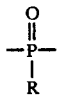

group, R is preferably a methoxy group, and most desirably R is a phenoxy group.

When G is an N-substituted or unsubstituted iminomethylene group, R is preferably a methyl group, an ethyl group, or a substituted or unsubstituted phenyl group.

The substituent groups for R include an acyl group, an acyloxy group, an alkyloxycarbonyl group, an aryloxycarbonyl group, an alkenyl group, an alkynyl group, and a nitro group, as well as those groups described for Y.

Most desirably, G of formula (I) is a carbonyl group.

Further, R of formula (I) may be a group which causes a cyclic reaction forming a cyclic structure comprising the portion —G—R to separate the G—R portion from the rest portion of the molecule. Specifically, the group is represented by the following formula (a):

$$-R_3-Z_1 \qquad \text{(a)}$$

wherein $Z_1$ represents a group capable of making a nucleophilic attack on G to separate $-G-R_3-Z_1$ portion from the rest portion of the molecule, and $R_3$ represents a group necessary for forming a cyclic structure formed by G, $R_3$ and $Z_1$ by the nucleophilic attack on $Z_1$ or G.

More specifically, $Z_1$ represents a group which can easily make a nucleophilic attack on G in the following reaction intermediate produced by oxidation or like reaction of a hydrazine compound of formula (I) to separate Y—N=N group from G.

$$Y-N=N-G-R_3-Z_1$$

Particularly, $Z_1$ may be a functional grOup which directly reacts with G, such as OH, SH, COOH or $NHR_4$ in which $R_4$ represents a hydrogen atom, alkyl group, aryl group, heterocyclic group, $-COR_5$ or $-SO_2R_5$ (in which $R_5$ represents a hydrogen atom, alkyl group, aryl group or heterocyclic group) (OH, SH, COOH and $NHR_4$ may be temporarily protected by, e.g., hydrolysis of alkali which produces these groups) or a functional group which reacts with a nucleophilic agent such as hydroxyl ion or sulfinic acid ion to become capable of reacting with G, such as

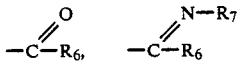

in which $R_6$ and $R_7$ each represents a hydrogen atom, alkyl gorup, alkenyl group, aryl group or heterocyclic group.

As the rings formed by G, $R_3$ and $Z_1$, 5-membered or 6-membered rings are preferred.

Of these groups represented by formula (a), preferred ones are those represented by the following formulae (b) and (c):

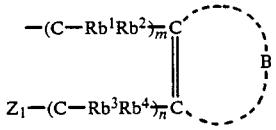

(b)

wherein $Rb^1$, $R^2$, $Rb^3$ and $Rb^4$, which may be the same or different, each represents a hydrogen, an alkyl group (preferably having 1 to 12 carbon atoms), an alkenyl group (preferably having 2 to 12 carbon atoms), or an aryl group (preferably having 6 to 12 carbon atoms), B represents an atomic group necessary for forming a 5-membered or 6-membered ring which may have at least one substituent, m and n each is 0 or 1 provided that both of them don't represent 0, and $Z_1$ is defined as above;

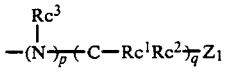

(c)

wherein $Rc^1$ and $Rc^2$, which may be the same or different, each represents a hydrogen atom, an alkyl group, an alkenyl gorup, an aryl group or a halogen atom, $Rc^3$ represents a hydrogen atom, an alkyl group, an alkenyl group, or an aryl group, p is 0 or 1, q represents an integer of from 1 to 4, and $Z^1$ is defined as above.

In formula (b), as the 5-membered or 6-membered rings formed by B, there may be mentioned a cyclohexene ring, a cycloheptene ring, a benzene ring, a naphthalene ring, a pyridine ring, and a quinoline ring, etc.

In formula (c), $Rc^1$, $Rc^2$ and $Rc^3$ may be combined each other to form a ring so long as $Z^1$ has a structure capable of making an intermolecular nucleophilic attack on G. $Rc^1$ and $Rc^2$ are preferably hydrogen atoms, halogen atoms or alkyl groups. $Rc^3$ is preferably an alkyl group or an aryl group. q is preferably an integer of from 1 to 3. p represents 1 or 2 when q is 1 and p represents 0 or 1 when q is 2 or 3. Further, when q is 2 or 3 the plural $CRc^1Rc^2$'s may be the same or different.

In formula (I), $A^1$ and $A^2$ each represents for example, a hydrogen atom, alkylsulfonyl group and arylsulfonyl group having not more than 20 carbon atoms (preferably a phenylsulfonyl group or substituted phenylsulfonyl group wherein the sum of the Hammett substituent constants is not less than −0.5), or an acyl group having not more than 20 carbon atoms (preferably a benzoyl gorup, a substituted benzoyl group wherein the sum of the Hammett substituent constants is not less than −0.5, or a linear chain, branched or cyclic, unsubstituted or substituted acyl group (as the substituents, there may be mentioned a halogen atom, an ehter group, a sulfonamido group, a carbonamido group, a hydroxyl group, a carboxy group and a sulfonic acid group).

More desirably, $A^1$ and $A^2$ are each hydrogen atoms.

Ballast groups such as those normally used to immobilize photographically useful additives such as couplers may be included in Y or R of formula (I).

Ballast groups are relatively inactive groups to photographic properties and have at least 8 carbon atoms. The ballast groups are selected from alkyl groups, alkoxy groups, a phenyl group, alkylphenyl groups, a phenoxy group, alkylphenoxy groups, etc.

Groups enhancing adsorption to the silver halide grain surface may be incorporated in Y or R of formula (I). These adsorption enhancing groups include thiourea groups, heterocyclic thioamido groups, mercapto heterocyclic groups, triazole groups, as disclosed in U.S. Pat. Nos. 4,385,108, and 4,459,347, JP-A-59-195233, JP-A-59-200231, JP-A-59-201045, JP-A-59201046, JP-A-59-201047, JP-A-59-201048, JP-A-59-201049, JP-A-61-170733, JP-A-61-270744, JP-A-62-948, and Japanese Patent Application Nos. 62-67508, 62-67509 and 62-67510.

Examples of compounds represented by formula (I) are indicated below, but the present invention is not limited to these compounds.

1

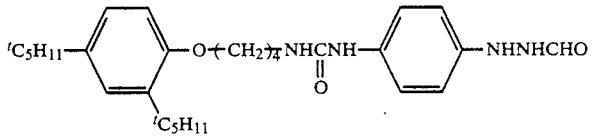

2

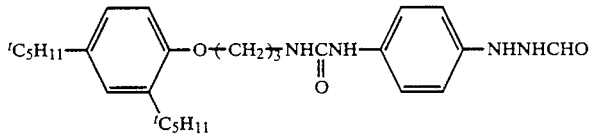

3

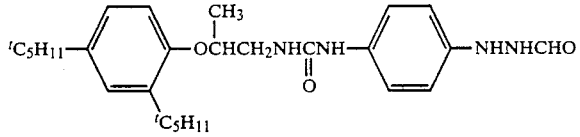

4

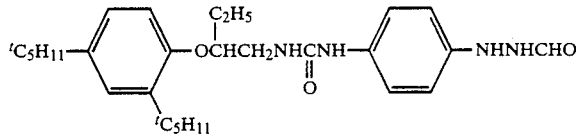

5

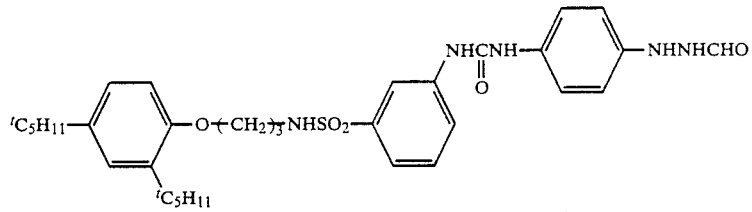

6

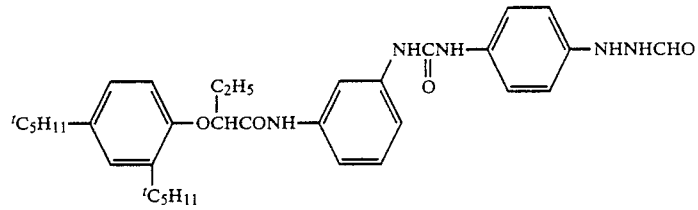

7

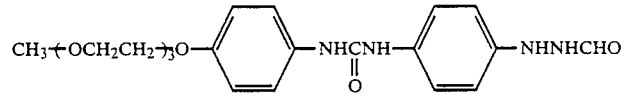

8

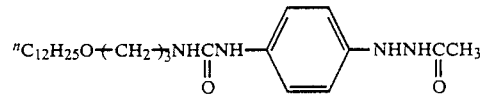

-continued
9
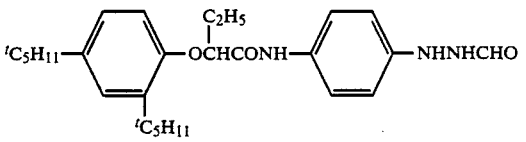
10
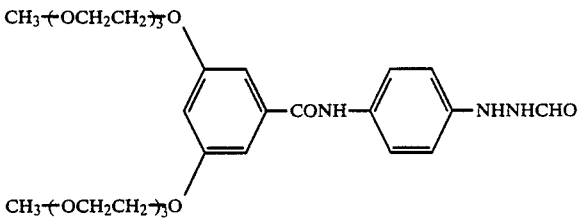
11
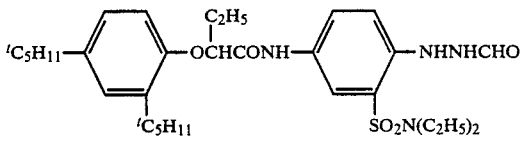
12
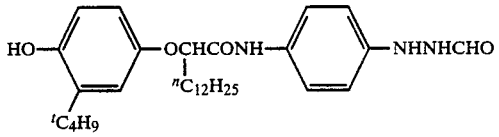
13
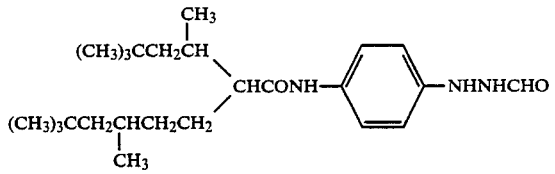
14
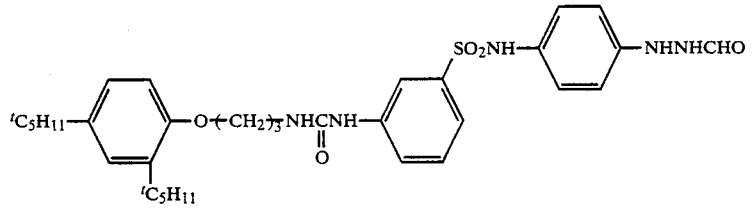
15
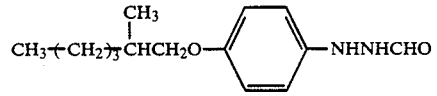
16
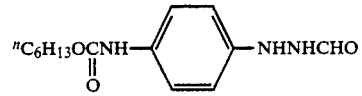
17
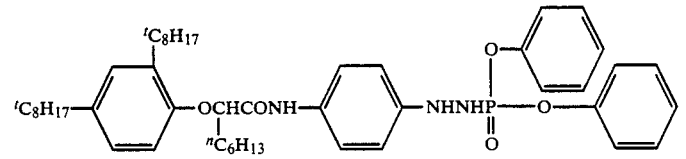
18
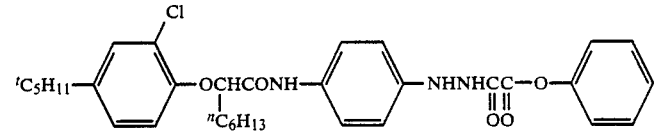

-continued
19
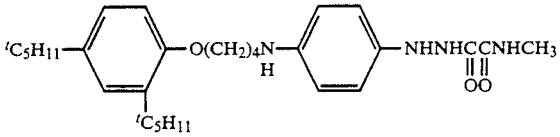
20
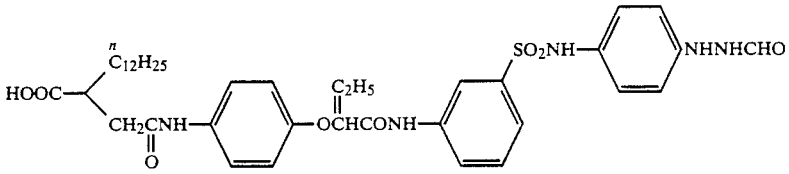
21
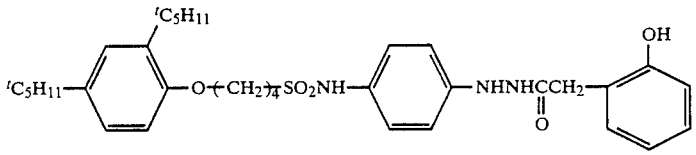
22
$^{n}-C_{12}H_{25}-NHNHCHO$
23
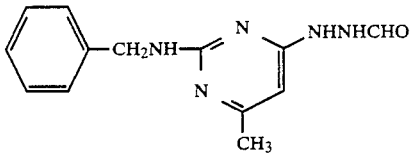
24
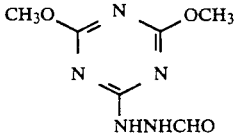
26
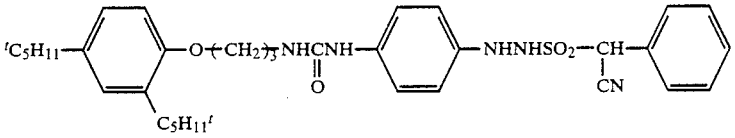
27
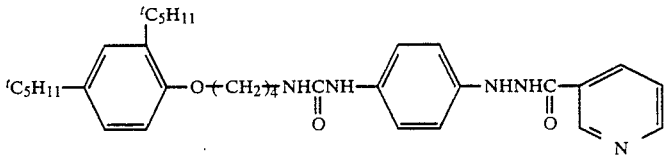
28
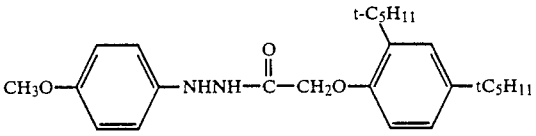
29
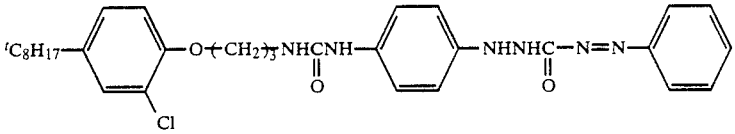

-continued
30
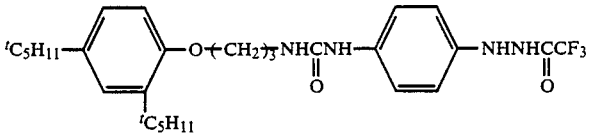
31
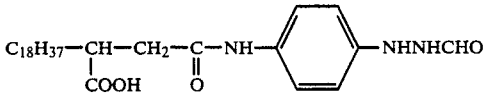
32
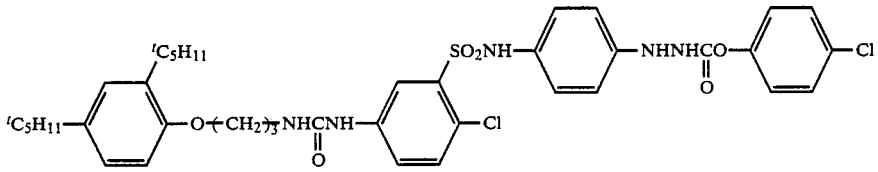
33
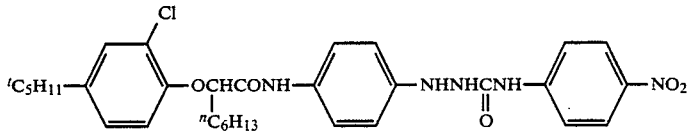
34
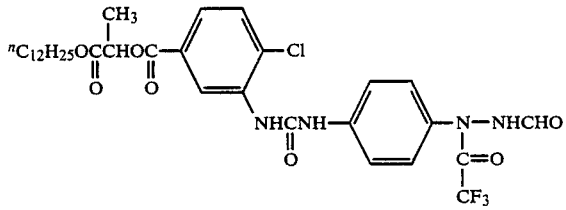
35
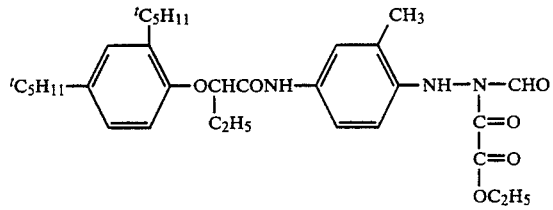
36
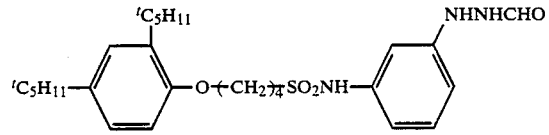
37
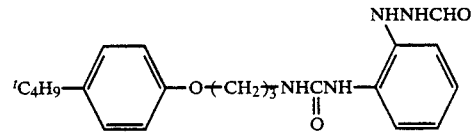
38
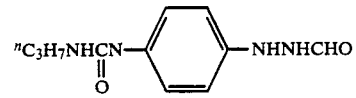
39
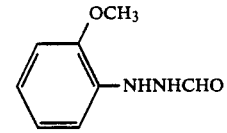

-continued
40
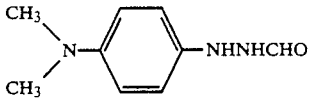
41
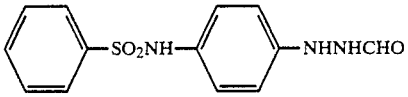
42
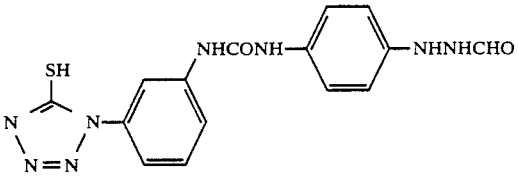
43
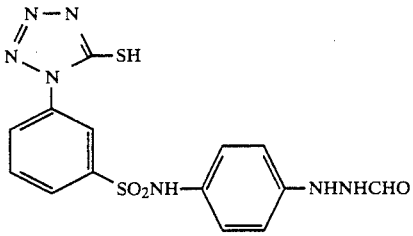
44
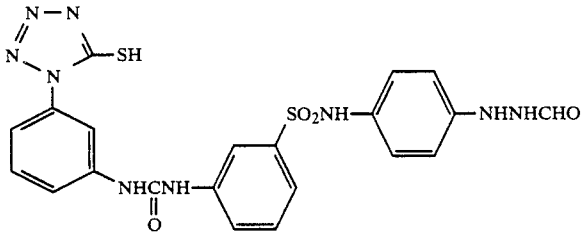
45
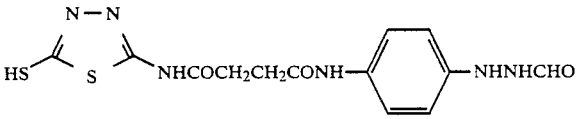
46
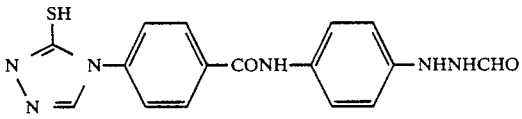
47
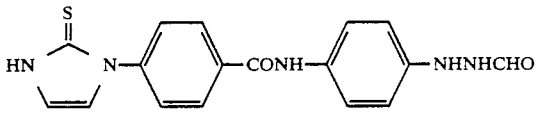
48
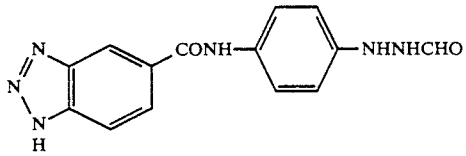
49
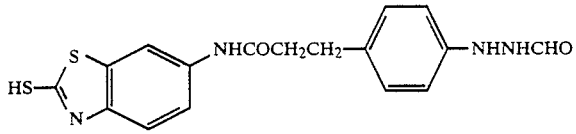

-continued
50
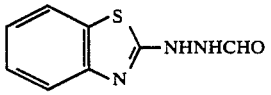
51
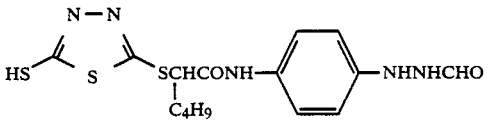
52
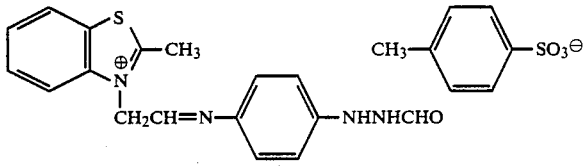
53
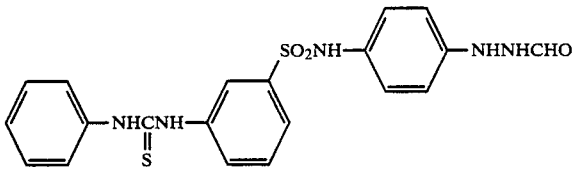
54
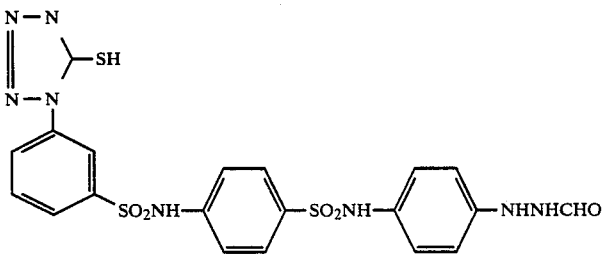
55
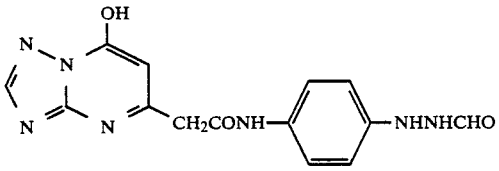
56
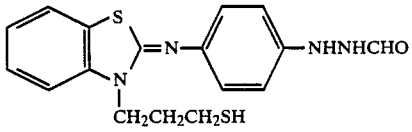
57
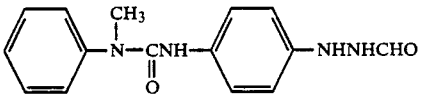
58)
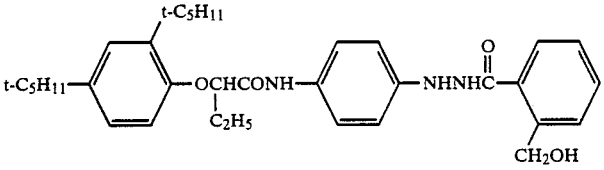

-continued
59)
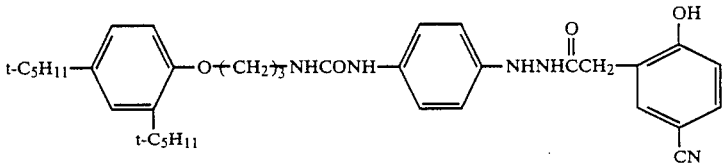
60)
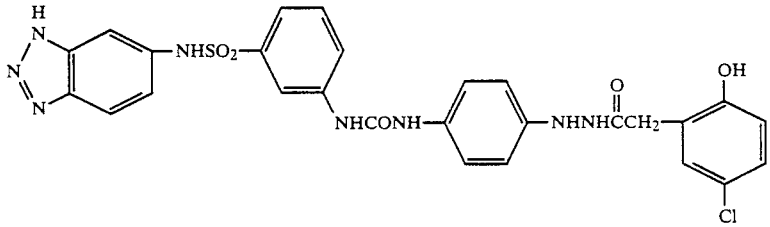
61)
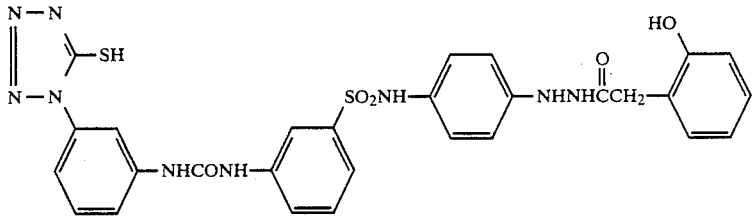
62)
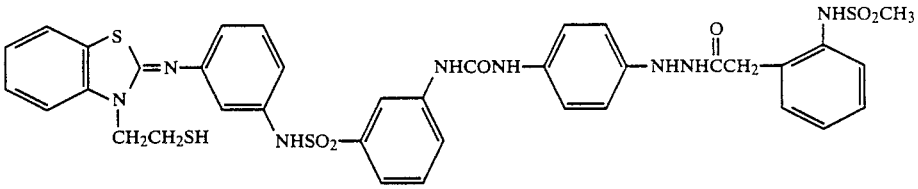
63)
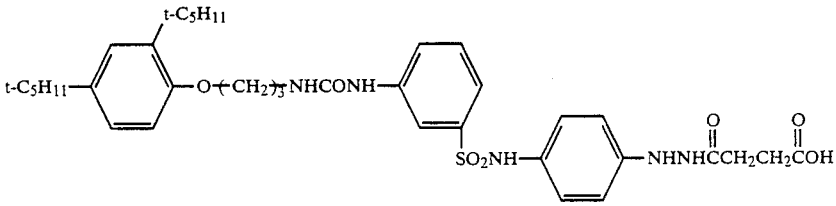
64)
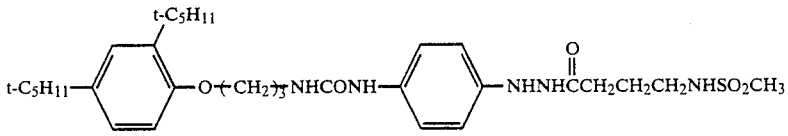
65)
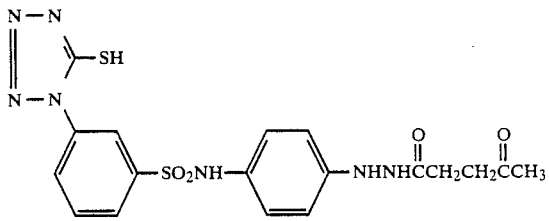
66)
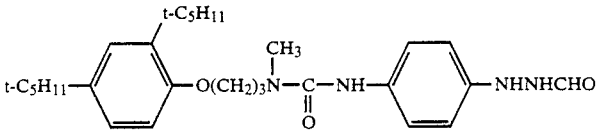
Other hydrazine derivatives for use in the present invention are disclosed in *Research Disclosure* Item 23516 (November, 1983) page 346 and in the literature cited therein, and in U.S. Pat. Nos. 4,080,207, 4,269,929, 4,276,364, 4,278,748, 4,385,108, 4,459,347, 4,560,638, 4,478,928 and 4,686,167, British Patent No. 2,011,391B, JP-A-60-179734, JP-A-62-270948, JP-A-63-29751, JP-A-61-170733, JP-A-61-270744, JP-A-62-384, JP-A-62-178246, JP-A-63-32538, JP-A-63-104047, JP-A-63-121838, JP-A-63-129337, JP-A-63-23246, JP-A-63-223744, and Japanese Patent Application Nos. 62-67528, 62-67529, 62-130819, 62-143469, 62-166117 and 62-247478.

Methods for the synthesis of compounds represented by formula (I) for use in the present invention are disclosed, for example, in JP-A-53-20921, JP-A-53-20922, JP-A-53-66732, JP-A-53-20318, JP-A-56-67843, JP-A-62-178246, JP-A-62-180361, JP-A-63-121838, JP-A-63-23744, JP-A-63-234244, JP-A-63-234245, Japanese Patent Application Nos. 62-130819 and 62-143469, and U.S. Pat. Nos. 4,459,347, 4,478,928 and 4,560,638.

Preferred water insoluble and organic solvent soluble polymers for use in the present invention are described below, but the invention is not limited to these polymers.

(A) Vinyl Polymers

Monomers used to form vinyl polymers of the present invention include acrylic acid esters such as methyl acrylate, ethyl acrylate, n-propyl acrylate, isopropyl acrylate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzylacrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxyethyl acrylate, 2-butoxyethyl acrylate, 2-(2-methoxyethoxy)ethyl acrylate, 2-(2-butoxyethoxy)ethyl acrylate, ω-methoxypolyethyleneglycol acrylate (number of mols addition n=9), 1-bromo-2-methoxyethyl acrylate and 1,1-dichloro-2-ethoxyethyl acrylate. Moreover, the monomers indicated below, for example, can also be used to form vinyl polymers of the present invention.

Methacrylic acid esters: Examples include methyl methacrylate, ethyl methacrylate, n-propyl methacrylate, iso-propyl methacrylate, n-butyl methacylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of mols addition n=6), allyl methacrylate and methacrylic acid dimethylaminoethylmethyl chloride.

Vinyl esters: Examples include vinyl acetate, vinyl propionate, vinyl butyrate, vinyl iso-butyrate, vinyl caproate, vinyl chloroacetate, vinyl methoxyacetate, vinyl phenylacetate, vinyl benzoate and vinyl salicylate.

Acrylamides: Examples include acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenyl acrylamide, dimethylacrylamide, diethylacrylamide, β-cyanoethylacrylamide, N-(2-acetoacetoxyethyl)acrylamide, diacetoneacrylamide and tert-octylacrylamide.

Methacrylamides: Examples include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetoacetoxyethyl)methacrylamide.

Olefins: Examples include dicyclopentadiene, ethylene, propylene, 1-butene, 1-pentene, vinyl chloride, vinylidene chloride, isoprene, chloroprene, butadiene, 2,3-dimethylbutadiene and styrenes; for example, styrene, methylstyrene, dimethylstyrene, trimethylstyrene, ethylstyrene, iso-propylstyrene, chloromethylstyrene, methoxystyrene, acetoxystyrene, chlorostyrene, dichlorostyrene, bromostyrene and methyl vinylbenzoate.

Vinyl ethers: Examples include methyl vinyl ether, butyl vinyl ether, hexyl vinyl ether, methoxyethyl vinyl ether, dimethylaminoethyl vinyl ether, etc.

Other compounds which can be used to form vinyl polymers of the present invention include, for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile and vinylidene.

Two or more of the monomers (for example, the above mentioned monomers) for use in forming polymers of this invention can be selected to impart various characteristics to the polymer of the present invention including for example, improving solubility.

Furthermore, monomers which have acid groups, such as those indicated below, can also be used as comonomers for the polymers of the present invention for the adjustment of solubility, etc. provided that the copolymer remains insoluble in water.

Monomers having acid groups for use in the present invention include acrylic acid; methacrylic acid; itaconic acid; maleic acid; monoalkyl itaconates, for example, monomethyl itaconate, monoethyl itaconate and monobutyl itaconate; monoalkyl maleates, for example, monomethyl maleate, monoethyl maleate and monobutyl maleate; citraconic acid; styrenesulfonic acid; vinylbenzene sulfonic acid; vinyl sulfonic acid; acryloyloxyalkylsulfonic acids, for example, acryloyloxymethylsulfonic acid, acryloyloxyethylsulfonic acid and acryloyloxypropylsulfonic acid; methacryloyloxyalkylsulfonic acids, for example, methacryloyloxymethylsulfonic acid, methacryloyloxyethylsulfonic acid and methacryloyloxypropylsulfonic acid; acrylamidoalkylsulfonic acids, for example, 2-acrylamido-2-methylethanesulfonic acid, 2-acrylamido-2-methylpropanesulfonic acid and 2-acrylamido-2-methylbutanesulfonic acid; methacrylamidoalkylsulfonic acids, for example, 2-methacrylamido-2-methylethanesulfonic acid, 2-methacryl-amido-2-methylpropanesulfonic acid and 2-methacrylamido-2-methylbutanesulfonic acid; and the alkali metal (for example, sodium, potassium, etc.) or ammonium ion salts of these acids.

In cases where a hydrophilic monomer (here, hydrophilic signifies a monomer which forms a water soluble homopolymer) is used as a co-monomer with the vinyl monomers indicated here and other vinyl monomers for use in the present invention, no particular limitation is imposed on the proportion of hydrophilic monomer in the copolymer provided that the copolymer does not become water soluble. Normally such hydrophilic monomers are used in an amount not exceeding 40 mol %, preferably in an amount not exceeding 20 mol % and, most desirably, in an amount not exceeding 10 mol %.

Furthermore, in cases where the hydrophilic comonomer copolymerized with a monomer of this invention has acid groups, the proportion in the copolymer of the comonomer having acid groups is normally not more than 20 mol %, and preferably not more than 10 mol %, and the absence of comonomers of this type is most desirable.

The monomers of this invention for use in forming the polymer are preferably methacrylate based, acrylamide based and methacrylamide based monomers. The acrylamide and methacrylamide based monomers are especially desirable.

(B) Polymers Formed by Condensation and Polyaddition Reactions

Polyesters formed from polyhydric alcohols and polybasic acids, and polyamides formed from diamines and dibasic acids, and from ω-amino-ω'-carboxylic acids, are generally known as condensation polymers. Polymers such as the polyurethanes are formed from diisocyanates and dihydric alcohols by means of a polyaddition reaction.

Glycols having an HO-$R_1$—OH structure (wherein $R_1$ is a hydrocarbon chain, especially an aliphatic hydro carbon chain, having from 2 to about 12 carbon atoms), or polyalkyleneglycols, are useful polyhydric alcohols, and acids having an HOOC-$R_2$—COOH structure (wherein $R_2$ represents a single bond or a hydrocarbon chain having from 1 to about 12 carbon atoms) are useful polybasic acids.

Examples of polyhydric alcohols for use in forming polymers of the present invention include ethylene glycol, diethylene glycol, triethylene glycol, 1,2-propylene glycol, 1,3-propylene glycol, trimethylolpropane, 1,4-butanediol, iso-butylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecane-diol, glycerine, diglycerine, triglycerine, 1-methylglycerine, erythritol, mannitol and sorbitol.

Examples of polybasic acids for use in forming polymers of the present invention include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isohymelic acid, cyclopendadiene-maleic anhydride adduct and rosinmaleic anhydride adduct.

Diamines for use in forming polymers of the present invention include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene and bis(4-aminophenyl)ether.

Examples of ω-amino-ω-carboxylic acids for use in forming polymers of the present invention include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid and 4-(4-aminophenyl)-butanoic acid.

Examples of diisocyanates for use in forming polymers of the present invention include ethylenediisocyanate, hexamethylenediisocyanate, m-phenylenediisocyanate, p-phenylenediisocyanate, p-xylenediisocyanate and 1,5-naphthyldiisocyanate.

(C) Cellulose Derivatives

Cellulose derivatives for use as polymers of the present invention include those which are both soluble in low boiling point water immiscible organic solvents (for emulsification), and insoluble in water at pH 7 at room temperature. Examples of such cellulose derivatives for use in the present invention include, for example, cellulose nitrate, cellulose acetate, cellulose acetate propionate, cellulose acetate butyrate and 2-hydroxypropyl methyl cellulose, and the hydrogenated phthalylated cellulose derivatives which are preferred.

Hydrogenated phthalylated cellulose derivatives for use in the present invention are represented, for example, by the following general formula:

$$(R^1)_m(R^2)_n(R^3)_p(R^4)_qA$$

wherein A represents a glucose residual group of the cellulose structure, $R^1$ represents a hydroxyalkyl group having from 2 to 4 carbon atoms, $R^2$ represents an alkyl group having from 1 to 3 carbon atoms, $R^3$ represents the monoacyl groups of tetrahydrophthalic acid or hexahydrophthalic acid, $R^4$ represents an aliphatic monoacyl group having from 1 to 3 carbon atoms, m has a value of from 0 to 1.0, n has a value of from 0 to 2.0, p has a value of from 0.2 to 1.0, q has a value of from 0 to 2.0, and wherein the sum of m, n and p has a maximum value of 3 (these numbers indicate the number of constituent mols relative to the glucose residue).

Examples of $R^1$ include the 2-hydroxyethyl group, the 2-hydroxypropyl group and the 4-hydroxybutyl group.

Examples of $R^4$ include the acetyl group, the propionyl group and the butyryl group.

Examples of hydrogenated phthalylated cellulose derivatives for use in the present invention are indicated below in formulae P-168 to P-174, but the invention is not limited to these examples. (The figures in parenthesis for each illustrative compound indicated the number of moles of the substituent group per glucose residue.)

(D) Others

Additional polymers for use in the present invention include polyesters and polyamides which are obtained by ring opening polymerization:

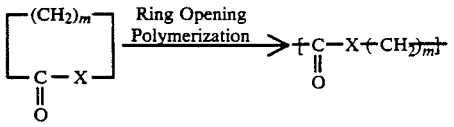

wherein, X represents an —O— group or an —NH— group, and m represents an integer of value 4 to 7. The —$CH_2$— groups may be branched.

Monomers of this type include β-propiolactone, ε-caprolactone, dimethylpropiolactone, α-pyrrolidone, α-piperidone, ε-caprolactam and α-methyl-ε-caprolactam.

Two or more of any of the types of polymer of the present invention as disclosed above can be used conjointly.

In the present invention, "water insoluble and organic solvent soluble polymer" signifies a polymer having a solubility of not more than 3 grams, and preferably not more than 1 gram, in 100 grams of distilled water at room temperature (i.e., about 20 ° C. to 25° C.) and a solubility of about 10% or more in an organic solvent.

the organic solvent soluble polymers for use in the present invention are prefer ably polymers wherein from 30 to 70 wt % of the components thereof have a molecular weight of not more than 40,000.

Examples of polymers for use in the present invention are indicated below, but the invention is not limited to these examples.

| Example | Type of Polymer |
|---|---|
| P-1 | Poly(vinyl acetate) |
| P-2 | Poly(vinyl propionate) |
| P-3 | Poly(methyl methacrylate) |
| P-4 | Poly(ethyl methacrylate) |
| P-5 | Poly(ethyl acrylate) |
| P-6 | Vinyl acetate/vinyl alcohol copolymer (95:5) |
| P-7 | Poly(n-butyl acrylate) |
| P-8 | Poly(n-butyl methacrylate) |
| P-9 | Poly(iso-butyl methacrylate) |
| P-10 | Poly(iso-propyl methacrylate) |
| P-11 | Poly(decyl methacrylate) |
| P-12 | n-Butyl acrylate/acrylamide copolymer (95:5) |
| P-13 | Poly(chloromethyl acrylate) |
| P-14 | 1-4-Butanediol/adipic acid polyester |
| P-15 | Ethyleneglycol/sebacic acid polyester |
| P-16 | Polycaprolactone |
| P-17 | Poly(2-tert-butylphenyl acrylate) |
| P-18 | Poly(4-tert-butylphenyl acrylate) |
| P-19 | n-Butyl methacrylate/N-vinyl-2-pyrrolidone copolymer (90:10) |
| P-20 | Methyl methacrylate/vinyl chloride copolymer (70:30) |
| P-21 | Methyl methacrylate/styrene copolymer (90:10) |
| P-22 | Methyl methacrylate/ethyl acrylate copolymer (50:50) |
| P-23 | n-Butyl methacrylate/methyl methacrylate/styrene copolymer (50:30:20) |
| P-24 | Vinyl acetate/acrylamide copolymer (85:15) |
| P-25 | Vinyl chloride/vinyl acetate copolymer (65:35) |
| P-26 | Methyl methacrylate/acrylonitrile copolymer (65:35) |
| P-27 | Diacetoneacrylamide/methyl methacrylate copolymer (50:50) |
| P-28 | Vinyl methyl ketone/isobutyl methacrylate copolymer (55:45) |
| P-29 | Ethyl methacrylate/n-butyl acrylate copolymer (70:30) |
| P-30 | Diacetoneacrylamide/n-butyl acrylate copolymer (60:40) |
| P-31 | Methyl methacrylate/cyclohexyl methacrylate copolymer (50:50) |
| P-32 | n-Butyl acrylate/styrene methacrylate/diacetoneacrylamide copolymer (70:20:10) |

-continued

| Example | Type of Polymer |
|---|---|
| P-33 | N-tert-Butylmethacrylamide/methyl methacrylate/acrylic acid copolymer (60:30:10) |
| P-34 | Methyl methacrylate/styrene/vinylsulfonamide copolymer (70:20:10) |
| P-35 | Methyl methacrylate/phenyl vinyl ketone copolymer (70:30) |
| P-36 | n-Butyl acrylate/methyl methacrylate/n-butyl methacrylate copolymer (35:35:30) |
| P-37 | n-Butyl methacrylate/pentyl methacrylate/N-vinyl-2-pyrrolidone copolymer (38:38:24) |
| P-38 | Methyl methacrylate/n-butyl methacrylate/iso-butyl methacrylate/acrylic acid copolymer (37:29:25:9) |
| P-39 | n-Butyl methacrylate/acrylic acid copolymer (95:5) |
| P-40 | Methyl methacrylate/acrylic acid copolymer (95:5) |
| P-41 | Benzyl methacrylate/acrylic acid copolymer (90:10) |
| P-42 | n-Butyl methacrylate/methyl methacrylate/benzyl methacrylate/acrylic acid copolymer (35:35:25:5) |
| P-43 | n-Butyl methacrylate/methyl methacrylate/benzyl methacrylate copolymer (35:35:30) |
| P-44 | Poly(3-pentyl acrylate) |
| P-45 | Cyclohexyl methacrylate/methyl methacrylate/n-propyl methacrylate copolymer (37:29:34) |
| P-46 | Poly(pentyl methacrylate) |
| P-47 | Methyl methacrylate/n-butyl methacrylate copolymer (65:35) |
| P-48 | Vinyl acetate/vinyl propionate copolymer (75:25) |
| P-49 | n-Butyl methacrylate/3-acryloxybutane-1-sulfonic acid sodium salt copolymer (97:3) |
| P-50 | n-Butyl methacrylate/methyl methacrylate/acrylamide copolymer (35:35:30) |
| P-51 | n-Butyl methacrylate/methyl acrylate/vinyl chloride copolymer (37:36:27) |
| P-52 | n-Butyl methacrylate/styrene copolymer (90:10) |
| P-53 | Methyl methacrylate/N-vinyl-2-pyrrolidone copolymer (90:10) |
| P-54 | n-Butyl methacrylate/vinyl chloride copolymer (90:10) |
| P-55 | n-Butyl methacrylate/styrene copolymer (70:30) |
| P-56 | Poly(N-sec-butylacrylamide) |
| P-57 | Poly(N-tert-butylacrylamide) |
| P-58 | Diacetoneacrylamide/methyl methacrylate copolymer (62:38) |
| P-59 | Cyclohexyl methacrylate/methyl methacrylate copolymer (60:40) |
| P-60 | N-tert-Butylacrylamide/methyl methacrylate copolymer (60:40) |
| P-61 | Poly(N-n-butylacrylamide) |
| P-62 | tert-Butyl methacrylate/N-tert-butyl-acrylamide copolymer (50:50) |
| P-63 | tert-Butyl methacrylate/methyl methacrylate copolymer (70:30) |
| P-64 | Poly(N-tert-butylacrylamide) |
| P-65 | N-tert-Butylacrylamide/methyl methacrylate copolymer (60:40) |
| P-66 | Methyl methacrylate/acrylonitrile copolymer (70:30) |
| P-67 | Methyl methacrylate/vinyl methyl ketone copolymer (38:62) |
| P-68 | Methyl methacrylate/styrene copolymer (75:25) |
| P-69 | Methyl methacrylate/hexyl methacrylate copolymer (70:30) |
| P-70 | Poly(benzyl acrylate) |
| P-71 | Poly(4-biphenyl acrylate) |
| P-72 | Poly(4-butoxycarbonylphenyl acrylate) |
| P-73 | Poly(sec-butyl acrylate) |
| P-74 | Poly(tert-butyl acrylate) |
| P-75 | Poly[3-chloro-2,2-(chloromethyl)propyl acrylate] |
| P-76 | Poly(2-chlorophenyl acrylate) |
| P-77 | Poly(4-chlorophenyl acrylate) |
| P-78 | Poly(pentachlorophenyl acrylate) |
| P-79 | Poly(4-cyanobenzyl acrylate) |
| P-80 | Poly(cyanoethyl acrylate) |
| P-81 | Poly(4-cyanoethyl acrylate) |
| P-82 | Poly(4-cyano-3-mercaptobutyl acrylate) |
| P-83 | Poly(cyclohexyl acrylate) |
| P-84 | Poly(2-ethoxycarbonylphenyl acrylate) |
| P-85 | Poly(3-ethoxycarbonylphenyl acrylate) |

-continued

| Example | Type of Polymer |
|---|---|
| P-86 | Poly(4-ethoxycarbonylphenyl acrylate) |
| P-87 | Poly(2-ethoxyethyl acrylate) |
| P-88 | Poly(3-ethoxypropyl acrylate) |
| P-89 | Poly(1H,1H,5H-octafluoropentyl acrylate) |
| P-90 | Poly(heptyl acrylate) |
| P-91 | Poly(hexadecyl acrylate) |
| P-92 | Poly(hexyl acrylate) |
| P-93 | Poly(iso-butyl acrylate) |
| P-94 | Poly(iso-propyl acrylate) |
| P-95 | Poly(3-methoxybutyl acrylate) |
| P-96 | Poly(2-methoxycarbonylphenyl acrylate) |
| P-97 | Poly(3-methoxycarbonylphenyl acrylate) |
| P-98 | Poly(4-methoxycarbonylphenyl acrylate) |
| P-99 | Poly(2-methoxyethyl acrylate) |
| P-100 | Poly(4-methoxyphenyl acrylate) |
| P-101 | Poly(3-methoxypropyl acrylate) |
| P-102 | Poly(3,5-dimethyladamantyl acrylate) |
| P-103 | Poly(3-dimethylaminophenyl acrylate) |
| P-104 | Poly(vinyl tert-butyrate) |
| P-105 | Poly(2-methylbutyl acrylate) |
| P-106 | Poly(3-methylbutyl acrylate) |
| P-107 | Poly(1,3-dimethylbutyl acrylate) |
| P-108 | Poly(2-methylpentyl acrylate) |
| P-109 | Poly(2-naphthyl acrylate) |
| P-110 | Poly(phenyl methacrylate) |
| P-111 | Poly(propyl acrylate) |
| P-112 | Poly(m-tolyl acrylate) |
| P-113 | Poly(o-tolyl acrylate) |
| P-114 | Poly(p-tolyl acrylate) |
| P-115 | Poly(N,N-dibutylacrylamide) |
| P-116 | Poly(iso-hexylacrylamide) |
| P-117 | Poly(iso-octylacrylamide) |
| P-118 | Poly(N-methyl-N-phenylacrylamide) |
| P-119 | Poly(adamantyl methacrylate) |
| P-120 | Poly(benzyl methacrylate) |
| P-121 | Poly(2-bromoethyl methacrylate) |
| P-122 | Poly(2-tert-butylaminoethyl methacrylate) |
| P-123 | Poly(sec-butyl methacrylate) |
| P-124 | Poly(tert-butyl methacrylate) |
| P-125 | Poly(2-chloroethyl methacrylate) |
| P-126 | Poly(2-cyanoethyl methacrylate) |
| P-127 | Poly(2-cyanomethylphenyl methacrylate) |
| P-128 | Poly(4-cyanophenyl methacrylate) |
| P-129 | Poly(cyclohexyl methacrylate) |
| P-130 | Poly(dodecyl methacrylate) |
| P-131 | Poly(diethylaminoethyl methacrylate) |
| P-132 | Poly(2-ethylsulfinylethyl methacrylate) |
| P-133 | Poly(hexadecyl methacrylate) |
| P-134 | Poly(hexyl methacrylate) |
| P-135 | Poly(2-hydroxypropyl methacrylate) |
| P-136 | Poly(4-methoxycarbonylphenyl methacrylate) |
| P-137 | Poly(3,5-dimethyladamantyl methacrylate) |
| P-138 | Poly(dimethylaminoethyl methacrylate) |
| P-139 | Poly(3,3-dimethylbutyl methacrylate) |
| P-140 | Poly(3,3-dimethyl-2-butyl methacrylate) |
| P-141 | Poly(3,5,5-trimethylhexyl methacrylate) |
| P-142 | Poly(octadecyl methacrylate) |
| P-143 | Poly(tetradecyl methacrylate) |
| P-144 | Poly(4-butoxycarbonylphenylmethacrylamide) |
| P-145 | Poly(4-carboxyphenylmethacrylamide) |
| P-146 | Poly(4-ethoxycarbonylphenylmethacrylamide) |
| P-147 | Poly(4-methoxycarbonylphenylmethacrylamide) |
| P-148 | Poly(butyl butoxycarbonylmethacrylate) |
| P-149 | Poly(butyl chloroacrylate) |
| P-150 | Poly(butyl cyanoacrylate) |
| P-151 | Poly(cyclohexyl chloroacrylate) |
| P-152 | Poly(chloroethyl acrylate) |
| P-153 | Poly(ethyl ethoxycarbonylmethacrylate) |
| P-154 | Poly(ethyl ethacrylate) |
| P-155 | Poly(fluoroethyl methacrylate) |
| P-156 | Poly(hexyl hexyloxycarbonylmethacrylate) |
| P-157 | Poly(chloro-iso-butyl acrylate) |
| P-158 | Poly(iso-propyl chloroacrylate) |
| P-159 | Trimethylenediamine/glutaric acid polyamide |
| P-160 | Hexamethylenediamine/adipic acid polyamide |
| P-161 | Poly(α-pyrrolidone) |
| P-162 | Poly(ε-caprolactam) |
| P-163 | Hexamethylenediisocyanate/1,4-butanediol polyurethane |
| P-164 | p-Phenylenediisocyanate/ethylene glycol polyurethane |

-continued

| Example | Type of Polymer |
|---|---|
| P-165 | Poly(vinyl hydrogenated phthalate) |
| P-166 | Poly(vinyl acetal phthalate) |
| P-167 | Poly(vinyl acetal) |
| P-168 | 2-Hydroxypropyl methyl cellulose hexahydrophthalate (2-hydroxypropyl group: 0.28, methyl group: 1.65, hexahydrophthalyl group: 0.60) |
| P-169 | 2-Hydroxypropyl methyl cellulose hexahydrophthalate (2-hydroxypropyl group: 0.33, methyl group: 1.60, hexahydrophthalyl group: 0.69) |
| P-170 | 2-Hydroxypropyl methyl cellulose hexahydrophthalate (2-hydroxypropyl group: 0.22, methyl group: 1.81, hexahydrophthalyl group: 0.84) |
| P-171 | Cellulose acetate hexahydrophthalate (acetyl group: 1.23, hexahydrophthalyl group: 0.67) |
| P-172 | 2-Hydroxypropyl-4-hydroxybutyl methyl cellulose hexahydrophthalate (2-hydroxypropyl group: 0.28, 4-hydroxybutyl group: 0.06, methyl group: 1.53, hexahydrophthalyl group: 0.39) |
| P-173 | 2-Hydroxypropyl ethyl cellulose tetrahydrophthalate (2-hydroxypropyl group: 0.44, ethyl group: 0.92, tetrahydrophthalyl group: 0.41) |
| P-174 | 2-Hydroxypropyl methyl cellulose acetate hexahydrophthalate (2-hydroxypropyl group: 0.16, methyl group: 1.50, acetyl group: 0.42, hexahydrophthalyl group: 0.68) |
| P-175 | Tert-butylacrylamide/poly(oxyethylene methacrylate) copolymer (90:10) Polyoxyethylene n = 1 to 50. |

These compounds can be prepared using known methods, such as the methods disclosed, for example, in U.S. Pat. No. 3,392,022 and JP-B-49-17367.

SYNTHESIS EXAMPLE 1

Preparation of Methykl Methacrylate Polymer (P-3)

Methyl methacrylate (50.0 grams), 0.5 grams of poly(sodium acrylate), 0.1 gram of dodecylmercaptan and 200 ml of distilled water were introduced into a 500 ml three necked flask and the mixture was heated to 80° C. with stirring under a blanket of nitrogen. Dimethyl azobisisobutyrate (500 mg) was added as a polymerization initiator to start polymerization.

The reaction mixture was cooled after polymerization for a period of 2 hours, and 48.7 grams of the polymer P-3 was thus obtained in the form of beads following filtration, and water washing, the polymer which had been formed in the form of beads.

The component of the polymer thus obtained having a molecular weight of not more than 40,000, as measured by GPC (gas phase chromatography) was 53%.

SYNTHESIS EXAMPLE 2

Preparation of t-Butylacrylamide Polymer (P-57)

t-Butylacrylamide (50.0 grams), 50 ml of isopropyl alcohol and 250 ml of toluene were introduced into a 500 ml three necked flask and heated to 80° C. with stirring under a blanket of nitrogen.

A toluene solution (10 ml) containing 500 mg of azobisisobutyronitrile was added as a polymerization initiator to start polymerization.

The reaction mixture was cooled after polymerizing for a period of 3 hours, and 47.9 grams of the polymer P-57 was obtained by filtrating the solid which had precipitated on pouring the mixture into 1 liter of hexane, washing the filtered solid with hexane, and drying the product by heating under reduced pressure.

The component of the polymer thus obtained having a molecular weight of not more than 40,000 as measured by GPC, was 36%.

The methods by which the hydrazine derivatives of the present invention are contained in the fine polymer grains include (1) methods wherein the hydrazine derivative is dissolved in a water miscible organic solvent, the solution thus obtained is mixed with a loadable polymer latex and the hydrazine derivative is loaded onto the polymer, and (2) methods wherein the hydrazine derivative and the polymer are dissolved in a low boiling point organic solvent which is insoluble in water (wherein the solubility of the solvent in water at room temperature is not more than 30%) and wherein the resulting solution is emulsified and dispersed in an aqueous phase using emulsification promoters such as surfactants and gelatin, etc., as required. In either case, removal of the organic solvent once the hydrazine derivative has been included in the fine polymer particles is desirable with respect to storage stability. Furthermore, the method (1) above does not require much effort for emulsification and dispersion of the hydrazine derivative into the fine polymer particles, but it is difficult to introduce a large quantity of the hydrazine derivative into the polymer. On the other hand, method (2) above requires much effort for emulsification and dispersion of the hydrazine derivative into the fine polymer particles, but large quantities (i.e., 30 wt % or more) of the hydrazine derivative can be contained in the polymer. Moreover, the reactivity of the hydrazine derivative may be adjusted by varying the size of the polymer particles. It is also possible to include, in optional proportion and in a uniform manner, a plurality of hydrazine derivatives having different photographic effects into the fine polymer particles. Hence, the method described under (2) above has some advantages over the method described under (1) above and so this is the preferred method of dispersion.

Dispersions of fine polymer particles containing hydrazine derivatives of the present invention can be prepared as follows.

The hydrazine derivative and the polymer of the present invention are first completely dissolved in a low boiling point organic solvent. The resulting solution is next dispersed as fine particles in water, preferably in an aqueous hydrophilic colloid solution, and most desirably in an aqueous gelatin solution, using a dispersion promoter, such as a surfactant, as required, by means of ultrasonics, a colloid mill or a dissolver, for example, and included in the coating liquid.

Removal of the low boiling point organic solvent from the dispersion thus obtained is desirable with respect to the stability of the dispersion, and especially for preventing the precipitation of the hydrazine derivative during storage. Methods for the removal of the low boiling point organic solvent include heating and distillation under reduced pressure, heating and distillation at normal pressure under an atmosphere of nitrogen or argon, etc., noodle washing and ultrafiltration.

The term "low boiling point organic solvent" as used herein signifies an organic solvent which is useful for emulsification and dispersion and which can be essentially removed from the photosensitive material in the drying process after coating or by the methods outlined above, or which has a certain degree of water solubility such that it can be removed by washing with water.

Examples of low boiling point organic solvents for use in the present invention include ethyl acetate, butyl acetate, ethyl propionate, secondary butyl alcohol, methyl ethyl ketone, methylisobutyl ketone, $\beta$-ethoxyethyl acetate, methyl-cellosolve acetate and cyclohexanone.

Moreover, organic solvents which are completely miscible with water, for example, methyl alcohol, ethyl alcohol, acetone and tetrahydrofuran, can be used conjointly in part, as required.

Furthermore, these organic solvents can be used in combination thereof.

The average particle size of the polymer particles containing the hydrazine compounds of the present invention in the emulsions thus obtained is preferably from 0.02 $\mu$m to 2 $\mu$m, and most desirably from 0.04 $\mu$m to 0.4 $\mu$m. The particle size of the polymer particles can be measured, for example, using a "Nanosizer" made by and trade name of the British Coal Tar Co.

Various photographically useful hydrophobic substances can also be contained in the fine polymer particles in the emulsions of the present invention in an amount wherein the hydrazine derivative still achieves its intended purpose.

Examples of photographically useful hydrophobic substances which can be contained in the fine polymer particles of the present invention include agents for reducing the melting points of the hydrazine derivatives, high boiling point organic solvents, colored couplers, colorless couplers, developing agents, developing agent precursors, development inhibitors, development inhibitor precursors, ultraviolet absorbers, development accelerators, agents, such as hydroquinones, for the adjustment of gradation, dyes, dye releasing agents, antioxidants, fluorescent whiteners and antifogging agents. Furthermore, these hydrophobic substances can be used jointly.

In the present invention, it is desirable to use the agents for reducing the melting points of the hydrazine derivatives (hereinafter referred to as "melting point-reducing agents") in the polymer particles at the incorporation of hydrazine derivatives.

As the melting point-reducing agents used in the present invention, those represented by the following formulae (II) and (II') are preferred.

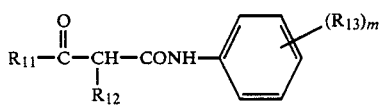

(II)

wherein $R_{11}$ represents a substituted or unsubstituted alkyl group or a substituted or unsubstituted phenyl group, $R_{12}$ represents a hydrogen atom, a halogen atom, a 5-membered heterocylic group, or a substituted or unsubstituted phenoxy group, $R_{13}$ represents a halogen atom, a carbonyl group, a carobxyl group, an acylamino group, or a sulfonamino group, and m is an integer of from 0 to 4.

Specific examples of the compounds represented by formula (II) are shown below, but the present invention is not limited to those examples.

(II-1)
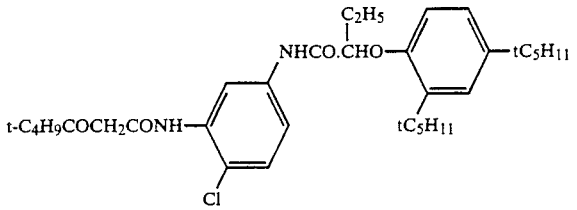
(II-2)
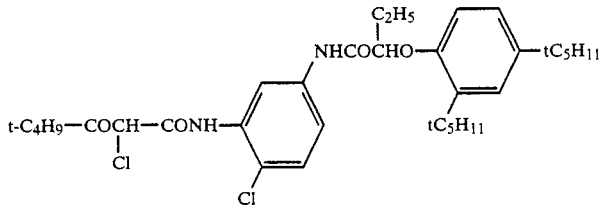
(II-3)
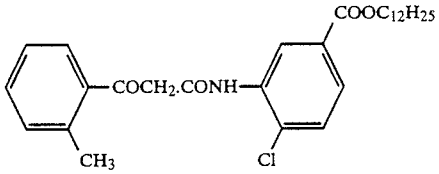
(II-4)
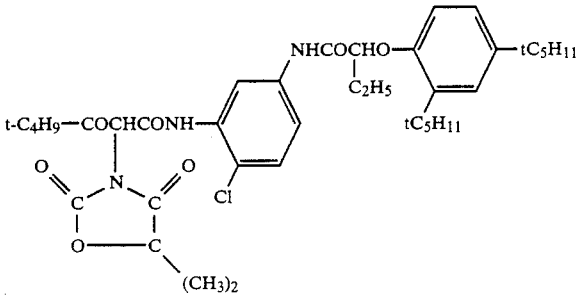
(II-5)
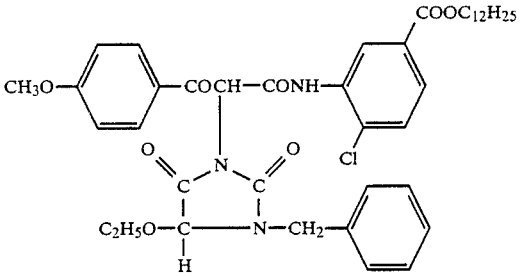
(II-6)
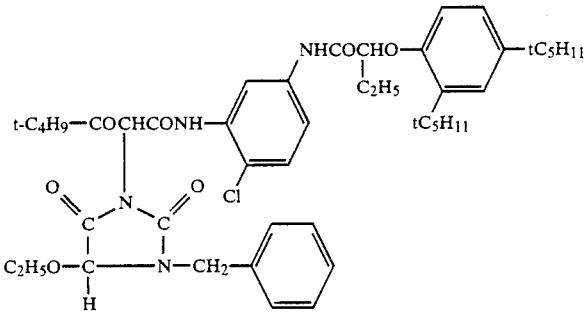

-continued
(II-7)
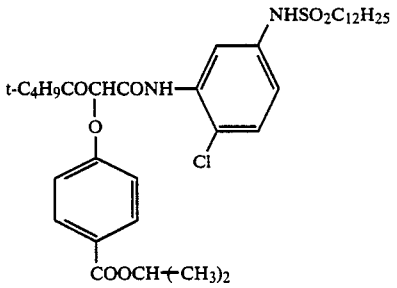
(II-8)
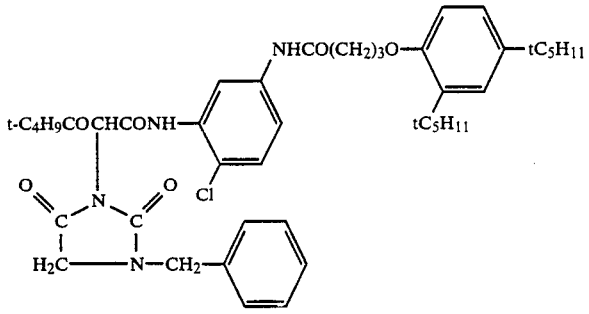
(II-9)
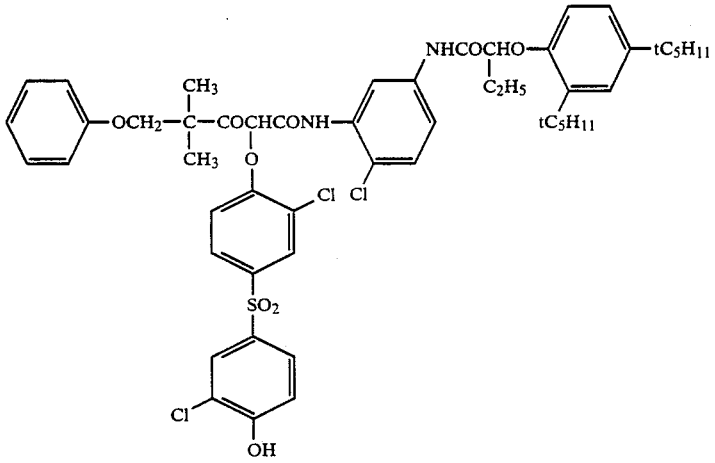
(II-10)
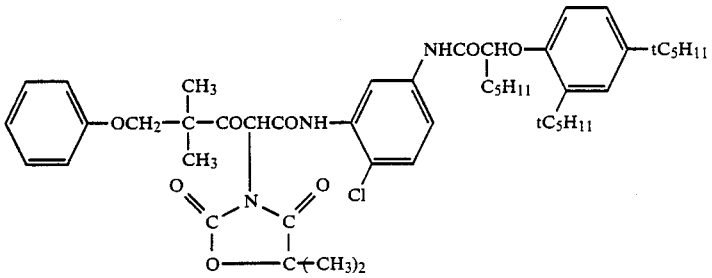

-continued (II-11)

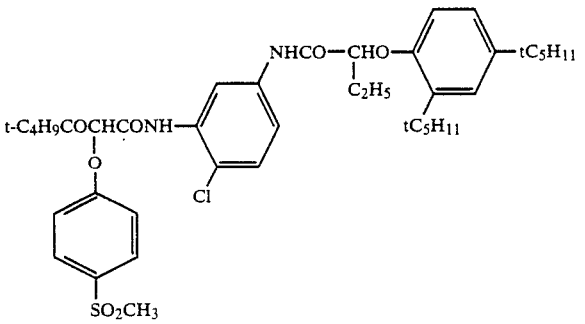

(II-12)

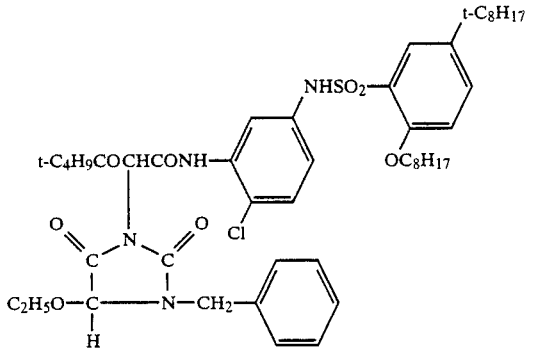

(II-13)

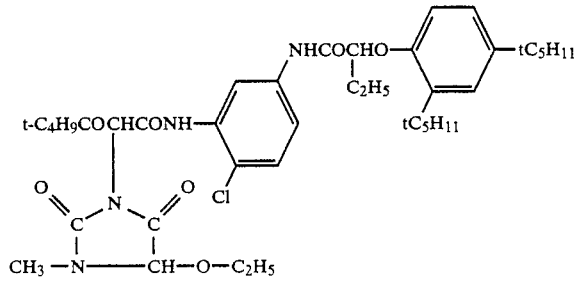

(II-14)

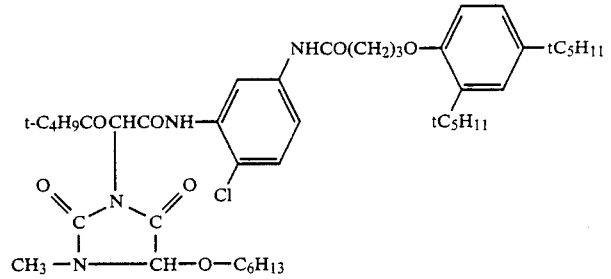

Formula (II') is shown below.

$$Z—Q \qquad \text{(II')}$$

wherein Z represents an aliphatic group or an aromatic group, and Q represents a hydrogen atom, a substituted or unsubstituted alkyl group having 20 or less carbon atoms, or a substituted or unsubstituted phenyl group having 20 or less carbon atoms.

In formula (II'), Z is preferably represented by the following formula:

$$Z'—L—$$

wherein Z' represents a substituted or unsubstituted alkyl group having 8 to 70, preferably 8 to 30 carbon atoms, or a substituted phenyl group having 8 to 70, preferably 8 to 30 carbon atoms, and L represents a divalent linking group (e.g., an alkylene group, an ehter group, a carbonamido group, a carbamoyl group, a sulfamoyl group, a sulfonamido group, a cargbonyl group, a sulfon group, a group —S—, a group —SO— or a combination thereof).

The substituents for the alkyl group represented by Z' include an aryl group, an alkoxy group, a sulfonamido group, and a carbonamido group, etc. The substituents for the substituted phenyl group represented by Z' include an alkyl group, an aralkyl group, an alkoxy group, a substituted amino group, an acylamino group, a sulfonamido group, and a ureido group.

The most preferred group for Z is an alkyl substituted phenoxyalkaneamido group.

Specific examples of the compounds represented by formula (II) including the group represented by formula (II') are as follows.

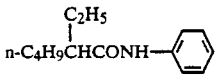
II'-1

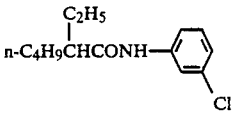
II'-2

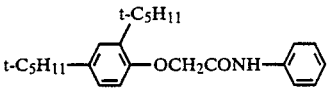
II'-3

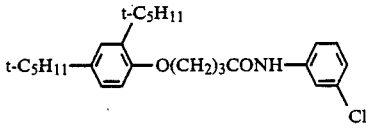
II'-4

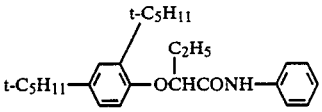
II'-5

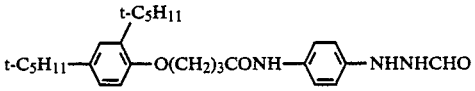
II'-6

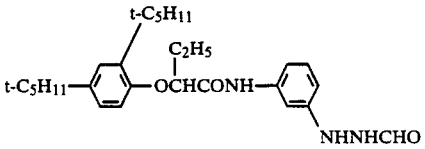
II'-7

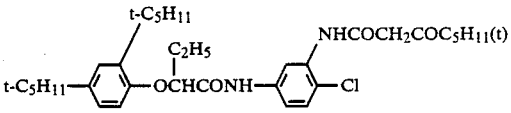
II'-8

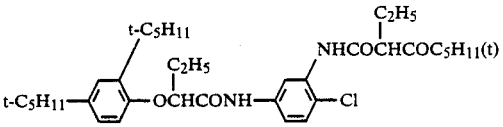
II'-9

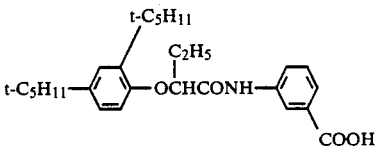
II'-10

Most of the compounds represented by formulae (II) and (II') are known compounds and can be easily synthesized by one skilled in this organic synthesis art.

In the present invention, it is preferred to use at least one of the compounds represented by the following formula (III) in the photographic material to obtain a further high contrast and to improve the silver developability. It is desirable to use the compounds by dissolving in an organic solvent with the hydrazine derivative as in the form of emulsified dispersion.

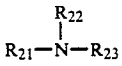
(III)

wherein $R_{21}$, and $R_{22}$ each represents a hydrogen atom or a substitued or unsubstituted alkyl group, and $R_{23}$ represents a substituted or unsubstituted alkyl group, a substituted phenyl group, or a 5-membered or 6-membered, substituted or unsubstituted heterocyclic group.

In formula (III), the substituted phenyl group of $R_{23}$ is preferably represented by the following formula:

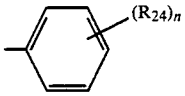

wherein $R_{24}$ represents a halogen atom, a substituted or unsubstituted alkyl group, a substituted or unsubstituted alkoxy group, or an acylamino group, and n is an integer of from 0 to 5.

Specific examples of the compounds represented by formula (III) are shown below, but the present invention is not limited to these examples.

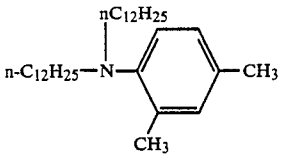
(III-1)

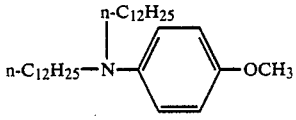
(III-2)

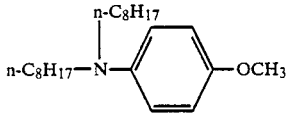
(III-3)

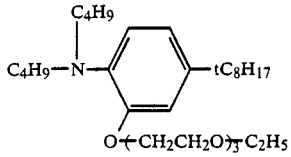
(III-4)

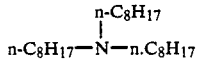
(III-5)

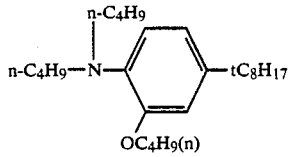
(III-6)

The compound represented by formula (III) is generally used in an amount of 1 to 30 wt %, preferab ly 2 to 20 wt %, more preferably 3 to 15 wt % of the hydrazine derivative.

Typical examples of the photographically useful hydrophobic substances are indicated below.

Developing agents

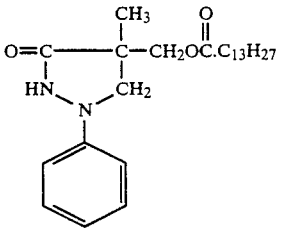

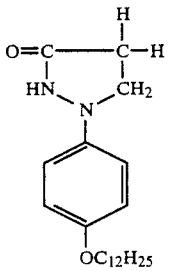

Development inhibitors

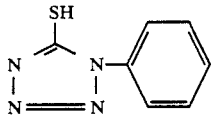

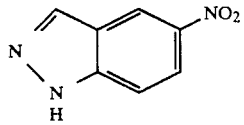

Development accelerators

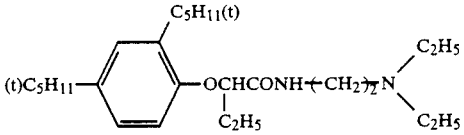

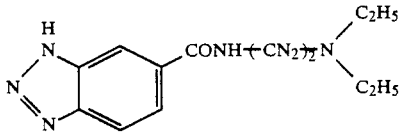

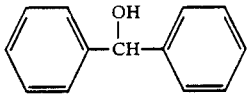

Hydroquinones

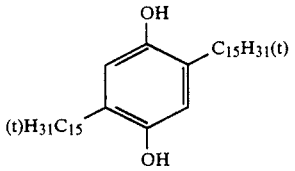

-continued

Hydroquinones

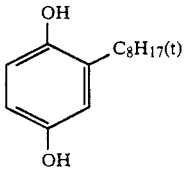

Antioxidants

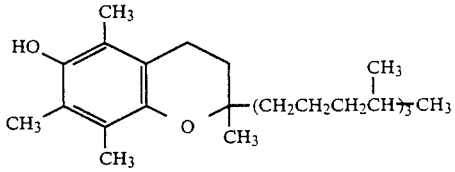

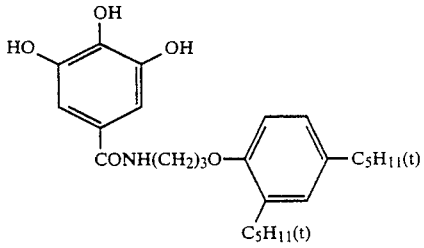

Ultraviolet absorber

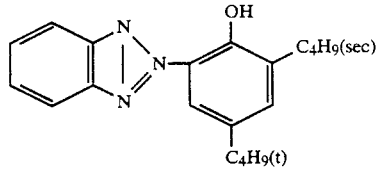

In this invention, the aforementioned hydrazine derivatives are normally used in an amount within the range of from $10^{-6}$ to $5\times10^{-2}$ mol per mol of silver, and they are preferably used in an amount within the range of from $10^{-5}$ to $2\times10^{-2}$ mol per mol of silver. Furthermore, the hydrazine derivatives may be used individually or in combination thereof.

In this invention, the aforementioned polymers are normally used in an amount within the range of from 10 to 400 wt % with respect to the hydrazine derivative, and they are preferably used in an amount within the range of from 20 to 300 wt % with respect to the hydrazine derivative.

Photosensitive materials of this invention preferably comprise auxiliary layers, such as protective layers, intermediate layers, filter layers, antihalation layers, backing layers, etc., as well as silver halide emulsion layers.

Thus, the fine polymer particles containing the hydrazine derivatives of the present invention can be added to any of the above indicated layers, as required. However, addition to the silver halide emulsion layer or layers adjacent thereto is preferred.

The anionic surfactants having an acidic group, for example, a carboxyl group, sulfo group, phospho group, sulfate ester group or phosphate ester group, are suitable for use in the present invention and, of these surfactants, those having a HLB value of from 8 to 14 are especially desirable (the HLB value is obtained by the organic or inorganic method, see pages 10–11 of *Emulsification and Dissolution Techniques,* third edition, by Susumu Tsuji, published by Kogyo Tosho Co.) (1979), for details). For example, sodium 2-(N-methyl-N-oleolylamino)ethanesulfonate is appropriately used for dispersing the fine polymers containing the hydrazine derivatives of the present invention into a hydrophilic colloid or coating liquid thereof.

No particular limitation is imposed upon the silver halide emulsions for use in the present invention. Mixed silver halides, for example silver chlorobromide, silver iodobromide and silver chloroiodobromide can be used as well as silver chloride and silver bromide. However, in cases where silver iodobromide or silver chloroiodobromide are used, it is desirable that the silver iodide content is not exceed 5 mol %.

Superhigh contrast negative images can be obtained in connection with the present invention using surface latent image type silver halides wherein the latent image is formed principally on the surface, and direct positive images can be obtained using internal latent image type silver halides wherein the latent image is formed principally within the grains. Here, a surface latent image type silver halide is a silver halide as described, for example, in U.S. Pat. No. 4,224,401. This invention is particularly effective for superhigh contrast negative image silver halide photosensitive materials wherein surface latent image type silver halide emulsions are used, the characteristics of which are affected by the degree of dispersion of the hydrazine compounds.

No particular limitations are imposed on the form, crystal habit and size distribution of the silver halide grains, but mono-dispersions having a grain size of not more than 0.7 μm are preferred for the formation of superhigh contrast negative images.

Furthermore, two or more silver halide photographic emulsions which have been formed separately can be mixed together for use in the present invention. Moreover, the crystal structure of the silver halide grains may be uniform though the interior or they may have a layer structure wherein the interior and exterior parts are different, or they may be of the conversion type as disclosed in British Patent No. 635,841 and U.S. Pat. No. 3,622,318. These photographic emulsions can be prepared using the methods described, for example, in *The Theory of the Photographic Process,* (4th Edition) by Mees, published by MacMillan, 1976; *Chemie et Physique Photographique,* by P. Grafkides, published by Paul Montel, 1957; *Photographic Emulsion Chemistry,* by G.F. Duffin, published by Focal Press, 1966; and *Making and Costing Photographic Emulsion,* by V.L. Zelikman et al., published by Focal Press, 1964.

Cadmium salts, zinc salts, lead salts, thallium salts, iridium salts or complex salts thereof, rhodium salts or complex salts thereof, and iron salts or complex salts thereof, for example, can be present during formation of the silver halide grain nuclei or during the physical ripening process.

Soluble salts are normally removed from the emulsion having the polymer containing the hydrazine compounds of the present invention after precipitation and growth or after physical ripening. These soluble salts may be removed by noodle washing or by flocculation using the inorganic salt of a multi-valent anion, for example, sodium sulfate, an anionic surfactant, an anionic polymer (for example, poly(styrenesulfonic acid)) or a gelatin derivative (for example, an aliphatic acylated gelatin, an aromatic acylated gelatin or an aromatic carbamoylated gelatin). The soluble salt removing process may be omitted.

Silver halide emulsions for use in the present invention can be used after chemical sensitization or immediately after physical ripening (as primitive emulsions), but chemical sensitization is normally carried out by the methods described, for example, in the books by Glafkides and Zelikman et al. mentioned above, and by H. Frieser in *Die Grundlagender Photographischen Prozesse mit Silberhalogeniden* published by Akademische Verlagsgesellschaft (1968).

Sulfur sensitization using active gelatin and compounds which react with silver (for example, thiosulfates, thioureas, mercapto compounds and rhodanines), reduction sensitization using reducing agents (for example, stannous salts, amines, hydrazine derivatives, formamidinesulfinic acid and silane compounds), and noble metal sensitization using noble metal compounds (for example, complex salts of metals of group VIII of the periodic table, such as platinum, iridium and palladium, as well as gold compounds) can be usded in the present invention either individually or in combination thereof.

Gelatin is useful as the hydrophilic colloid binder for use in the light-insensitive upper layers, emulsion layers or other layers of the present invention, but other hydrophilic colloids can be used.

For example, gelatin derivatives, graft polymers of gelatin and other polymers, proteins such as albumin and casein, cellulose derivatives, such as hydroxyethyl cellulose, carboxymethylcellulose and cellulose sulfate esters, sodium alginate, sugar derivates such as starch derivatives, and various types of synthetic hydrophilic homopolymers or copolymers, such as poly(vinyl alcohol), partially acetalated poly(vinyl alcohol), poly(N-vinyl pyrrolidone), poly(acrylic acid), poly(methacrylic acid), polyacrylamide, polyvinylimidazole and polyvinylpyrazole can be used as the hydrophilic colloids of the present invention.

Lime treated gelatin, acid treated gelatin and enzyme treated gelatin as disclosed in *Bull. Soc. Sci. Phot. Japan,* No. 16, page 30 (1966) can be used as the gelatin in the present invention, and the hydrolyzates and enzyme degradation products of gelatin can also be used.

The photographic emulsions for use in the present invention may be spectrally sensitized with methine dyes or by other means. The dyes which can be used for this purpose include cyanine dyes, merocyanine dyes, complex cyanine dyes, complex merocyanine dyes, holopolarcyanine dyes, hemicyanine dyes, styryl dyes and hemioxonol dyes. Dyes classified as cyanine dyes, merocyanine dyes and complex merocyanine dyes are especially useful dyes.

These sensitizing dyes can be used individually or in combination thereof. Combinations of sensitizing dyes are often used to obtain supersensitization. Dyes which do not themselves have a spectrally sensitizing action or substances which have essentially no absorption in the visible region, but which promote supersensitization, can be included in the emulsion together with the sensitizing dye.

Gelatin is useful as a binding agent or protective colloid in the emulsion layers and intermediate layers of photographic materials of the present invention, but other hydrophilic colloids can also be used for this purpose.

For example, gelatin derivatives, graft polymers of gelatin and other polymers, proteins such as albumin and casein; cellulose derivatives, such as hydroxyethyl cellulose, carboxymethylcellulose and cellulose sulfate esters, sodium alginate and sugar derivatives such as starch derivatives; and various types of synthetic hydrophilic homopolymers or copolymers, such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole can be used as a binding agent or protective colloid in the present invention.

Lime treated gelatin, acid treated gelatin and enzyme treated gelatin as disclosed in *Bull. Soc. Sci. Phot. Japan*, No. 16, page 30 (1966) can be used as a binding agent or protective colloid in the present invention and the hydrolyzates and enzyme degradation products of gelatin can also be used for this purpose.

Various compounds can be included in the photographic emulsions for use in the present invention in order to prevent the occurrence of fogging during the manufacture, storage or photographic processing of the photosensitive material, or in order to provide stabilize photographic performance. Thus various compounds known as anti-fogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially 1-phenyl-5-mercaptotetrazole); mercaptopyrimidines; mercaptotriazines; thioketo compounds such as, for example, oxazolinethione; azaindenes, for example, triazaindenes, tetraazaindenes (especially 4-hydroxysubstituted (1,3,3*a*,7)-tetraazaindenes) and pentaazaindenes; benzenethiosulfonic acid, benzenesulfinic acid, benzenesulfonic acid amide etc., can be added for this purpose.

Among these compounds, the benzotriazoles (for example, 5-methylbenzotriazole) and the nitroindazoles (for example, 5-nitroindazole) are especially desirable. Furthermore, these compounds can also be included in the processing baths used to process the photographic materials of the present invention.

Inorganic or organic film hardening agents can be included in the photographic emulsion layers and other hydrophilic colloid layers of the photographic materials of the present invention. For example, chromium salts (for example, chrome alum and chromium acetate), aldehydes (for example, formaldehyde, glyoxal, and glutaraldehyde), N-methylol compounds (for example, dimethylol urea and methyloldimethylhydantoin), dioxane derivatives (for example, 2,3-dihydroxydioxane), active vinyl compounds (for example, 1,3,4-triacryloylhexa-hydro-s-triazine and 1,3-vinylsulfonyl-2-propanol), active halogen compounds (for example, 2,4-dichloro-6-hydroxy-s-triazine), mucohalogen acids (for example, mucochloric acid and mucophenoxychloric acid) etc. can be used either individually or in combination thereof for this purpose.

Various surfactants can be included as coating promoters, for anti-static purposes, for improving sliding properties, for emulsification and dispersion purposes, for the prevention of sticking and for the improvement of photographic performance (for example, for accelerating development, increasing contrast and sensitization) in the photographic emulsion layers or other hydrophilic colloid layers of the photosensitive materials of the present invention.

For example, the following surfactants can be used in the present invention including non-ionic surfactants such as saponin (steroid based), alkyleneoxide derivatives (for example, polyethyleneglycol, polyethyleneglycol/polypropyleneglycol condensates, polyethyleneglycol alkyl ethers or polyethyleneglycol alkyl aryl ethers, polyethyleneglycol esters, polyethyleneglycol sorbitan esters, polyalkyleneglycol alkyl amines or amides and polyethyleneoxide adducts of silicones), glycidol derivatives (for example, alkenylsuccinic acid polyglycerides and alkylphenol polyglycerides), fatty acid esters of polyhydric alcohols and the alkyl esters of sugars; anionic surfactants which contain a carboxyl group, a sulfo group, a phospho group, a sulfate ester group or a phosphate ester group, etc., such as alkylcarboxylic acids, alkylsulfonic acids, alkylbenzenesulfonic acids, alkylnaphthalenesulfonic acids, alkyl sulfate esters, alkylene phosphate esters, N-acyl-N-alkyltaurins, sulfosuccinate esters, sulfoalkylpolyoxyethylene alkylphenyl ethers and polyoxyethylenealkyl phosphate esters; amphoteric surfactants such as amino acids, aminoalkylsulfonic acids, aminoalkyl sulfate or phosphate esters, alkylbetaines and amine oxides; and cationic surfactants such as alkylamine salts, aliphatic or aromatic quaternary ammonium salts, heterocyclic, for example, pyridinium or imidazolium, quaternary ammonium salts, and phosphonium salts or sulfonium salts which contain aliphatic or heterocyclic groups.

When polyalklene oxides are used in the present invention, those having a molecular weight of at least 600, as disclosed in JP-B-58-9412 are preferred.

Dispersions of water insoluble or sparingly soluble synthetic polymers can be included in the photographic materials for use in the present invention, in order to improve the dimensional stability of the photographic emulsion layers and other hydrophilic colloid layers. For example, the following polymers can be used in the present invention for this purpose including those wherein alkyl (meth)acrylates, alkoxyalkyl (meth)acrylates, glycidyl (meth)acrylates, (meth)acrylamides, vinyl esters (for example, ethyl acetate), acrylonitrile, olefins or styrene are used individually or in combination thereof as monomer units, and polymers wherein these monomer units are combined with acrylic acid, methacrylic acid, $\alpha,\beta$-unsaturated dicarboxylic acids, hydroxyalkyl (meth)acrylates, sulfoalkyl (meth)acrylates or styrenesulfonic acid, for example, as monomer compounds.

In cases where an internal latent image type silver halide emulsion is used for the silver halide emulsion of the present invention, the photosensitive materials can also be used in a color diffusion transfer process. In such a case, use can be made of the various additives disclosed, for example, in *Research Disclosure* No. 17643, section XXIII (November, 1978).

Conventional techniques can be used in the photographic prOcessing of the photosensitive materials of the present invention. Development processes for the formation of silver images (black and white development processing), color development processes for the formation of color images, and development processing for color diffusion transfer purposes (viscous development processing) can be performed using the photosensitive materials of the present invention.

The present invention is especially suitable for use in silver halide photosensitive materials wherein surface latent image type silver halide grains are used for forming superhigh contrast negative images. In this regards, stable development baths can be used without the need for a conventional infectious development or a highly alkaline development bath at a pH approaching 13 as disclosed in U.S. Pat. No. 2,419,975 to obtain high speed photographic performance with superhigh contrast.

Thus, the silver halide photosensitive material of the present invention can be used to satisfactorily obtain superhigh contrast negative image with development baths of pH 9.5 to 12.3, and especially those of pH from 10.5 to 12.3, containing at least 0.15 mol/liter of sulfite ion as a preservative.

No specific limitation is imposed upon the developing agents for use in the development baths for use in the present invention, but the inclusion of dihydroxybenzenes is preferred in order to easily obtain good screen dot quality, combinations of dihydroxybenzenes and 1-phenyl-3-pyrazolidones or combinations of dihydroxybenzenes and p-aminophenols can also be used.

The dihydroxybenzene developing agents for use in processing of the present invention include, for example, hyderoquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, and the use of hydroquinone is particularly preferred.

The 1-phenyl-3-pyrazolidone and derivatives thereof used as developing agents in the processing of the present invention include, for example, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

The p-aminophenol developing agents for use in the processing of the present invention include N-methyl-p-aminophenol, p-aminophenol, N-(β-hydroxyethyl)-p-aminophenol, N-(4-hydroxyphenyl)glycine, 2-methylpaminophenol and p-benzylaminophenol and, of these, the use of N-methyl-p-aminophenol is preferred.

The developing agent is preferably used at a concentration of from 0.05 to 0.8 mol/liter. Furthermore, when a dihydroxybenzene is combined with a 1-phenyl-3-pyrazolidone or a p-aminophenol, the former is preferably used at a concentration of from 0.05 to 0.5 mol per liter and the latter is preferably used at a concentration of not more than 0.06 mol/liter.

Sodium sulfite, potassium sulfite, lithium sulfite, ammonium sulfite, sodium bisulfite, potassium metabisulfite and formaldehyde/sodium bisulfite, etc. can be employed as the sulfite preservatives for use in the processing of the present invention. The sulfite is preferably used at a concentration of at least 0.3 mol/liter, and most desirably at a concentration of at least 0.4 mol/liter. The upper limit is a concentration of 2.5 mol/liter, and an upper limit of 1.2 mol/liter is preferred.

pH adjusting agents and buffers such as sodium hydroxide, potassium hydroxide, sodium carbonate, potassium carbonate, tri-sodium phosphate, tri-potassium phosphate, sodium silicate and potassium silicate are included among the alkalis which can be used for the adjustment of pH of the processing baths for the present invention.

Compounds such as boric acid and borax, development inhibitors such as sodium bromide, potassium bromide and potassium iodide, organic solvents such as ethyleneglycol, diethyleneglycol, triethyleneglycol, dimethylformamide, methylcellosolve, hexyleneglycol, ethanol and methanol, anti-foggants and agents for the prevention of black peppers, including mercaptobased compounds such as 1-phenyl-5-mercaptotetrazole, 2-mercaptobenzimidazole-5-sulfonic acid sodium salt, indazole based compounds such as 5-nitroindazole, and benztriazole based compounds such as 5-methylbenzotriazole, can be included as additives for use in the processing baths of the present invention as well as the components mentioned above, and toners, surfactants, defoaming agents, hard water softening agents, film hardening agents, and amino compounds as disclosed in JP-A-56-106244, etc. can also be used, as required.

The compounds disclosed in JP-A-56-24347 as anti-silver staining agents, the compounds disclosed in JP-A-62-212651 as agents for the prevention of uneven development, and the compounds disclosed in JP-A-61-67759 as dissolution aids can be used in the development baths for processing of the present invention.

Boric acid as disclosed in JPA-62-186259, and the sugars (for example, saccharose), oximes (for example, acetoxime), phenols (for example, 5-sulfosalicylic acid) and triphosphates (for example, the sodium and potassium salts) as disclosed in JP-A-60-93433 can be used as buffers in the development baths for use in processing of the present invention, but the use of boric acid is preferred.

The fixing baths for use in processing of the present invention are aqueous solution containing film hardening agents (for example, water soluble aluminum compounds), acetic acid and dibasic acids (for example, tartaric acid, citric acid, or salts thereof), as required, in addition to the fixing agents. The bath pH is preferably at least 3.8, and most desirably within the range of from 4.0 to 5.5.

Sodium thiosulfate and ammonium thiosulfate are examples of fixing agents for use in processing of the present invention, and ammonium thiosulfate is especially desirable due to the high fixing rate. The concentration of the fixing agent can vary appropriately, but it is generally from about 0.1 to about 5 mol/liter.

The water soluble aluminum salts for use principally as film hardening agents in the fixing baths for processing of the present invention are compounds for acid hardening of fixing baths, and examples of such materials include aluminum chloride, aluminum sulfate and chrome alum.

Tartaric acid and derivatives thereof and citric acid and derivatives thereof can be used individually, or in combination thereof, as the dibasic acids referred to above. These compounds are effective when used at a concentration of at least 0.005 mol per liter of fixing bath, and they are especially effective when used at a concentration of from 0.01 mol/liter to 0.03 mol/liter.

In practical terms, these dibasic acids include tartaric acid, potassium tartrate, sodium tartrate, potassium sodium tartrate, ammonium tartrate, ammonium potassium tartrate, etc.

The citric acid and derivatives thereof which are effective for use in the fixing baths of the present invention include, for example, citric acid, sodium citrate, potassium citrate, etc.

Preservatives (for example, sulfites and bisulfites), pH buffers (for example, acetic acid and boric acid), agents for adjusting pH (for example, ammonia and sulfate), agents for improving image storage properties (for example, potassium iodide) and chelating agents can be included, as required, in the fixing bath used for processing of the present invention. The pH buffers are used at a concentration of from 10 to 40 grams/liter, and preferably at a concentration of from 18 to 25 grams/-liter, due to the high pH of the development bath.

The fixing temperature and time for processing of the present invention are about the same as for development, and range from preferably about 20° C. to about 50° C., and from 10 seconds to 1 minute.

Furthermore, fungicides (for example, the compounds disclosed in *Bokin Bobai no Kaqaku (The Chemistry of Biocides and Fungicides)* by Hiroshi Horiguchi, and in the specification of JP-A-62-115154), washing accelerators (sulfites etc.) and chelating agents, etc. can be included in the water washing water for processing of the present invention.

Photographic materials which have been developed and fixed in accordance with the present invention are washed with water and dried. The water washing serves to remove, more or less completely, the silver salts which have been rendered soluble by fixing, and it is preferably carried out at a temperature of from about 20° C. to about 50° C. for a period of from 10 seconds to 3 minutes. Drying is carried out at a temperature of from about 40° C. to about 100° C. and the drying time is varied appropriately according to the ambient conditions, but it is normally best set between about 5 seconds and 3 minutes 30 seconds.

Roller transport type automatic processors disclosed in U.S. Pat. Nos. 3,025,779 and 3,545,971 can be used to process the materials of the present invention and are referred to herein as roller transport type processors. A roller transport type processor comprises the four stages of development, fixing, water washing and drying. The method of the present invention does not exclude use of other processes (for example, a stop process), but the use of these four processes is most desirable. It is possible to economize on water by using a two or three stage counter-flow washing system for the water washing process.

The development baths for use in processing of the present invention are preferably stored in the containers which have a low oxygen permeability as disclosed in JP-A-61-73147. Furthermore, the development baths for use in processing of the present invention preferably employ a replenishment system as disclosed in JP-A-62-91939.

The silver halide photographic materials of the present invention provide a high $D_{max}$ and it is possible to maintain a high density even with reduced screen dot areas when a reducing treatment is employed after the image has been formed.

No limitations are imposed in connection with the reducing bath for use in the present invention, which include those described, for example, on pages 738–744 of *The Theory of the Photographic Process* by Mees (Macmillan, 1954) and on pages 166–169 of *Shashin-Shori, Sono Riron to Jissai (Photographic Processing, Theory and Practice),* by Tetsuo Yano (Kyoritsu Shuppan, 1978), and of those disclosed, for example, in JP-A-50-27543, JP-A-52-68429, JP-A-55-17123, JP-A-55-79444, JP-A-57-10140, JP-A-57-142639, and JP-A-61-61155. Thus reducing baths for use in the present invention may contain permanganates, persulfates, ferric salts, cupric salts, ceric salts, ferricyanides, dichromates, etc., either individually or in combination as oxidizing agents and inorganic acids, such as sulfuric acid, and alcohols, as required, and reducing baths which contain oxidizing agents, such as ferricyanides or ferric salts of ethylenediamine tetraacetic acid, silver halide solvents such as thiosulfates, thiocyanates, thiourea or derivatives thereof, and, as required, inorganic acids such as sulfuric acid.

Typical examples of reducing baths for use in the present invention include Farmers reducer, the ferric salt of ethylenediamine tetraacetic acid, potassium permanganate, ammonium persulfate reducer (for example, Kodak R-5, a trade name of Kodak), and ceric salt reducer.

The reducing treatment for processing of the present invention is carried out at a temperature of from 10° C. to 40° C., preferably of from 15° C. to 30° C. and the reducing process is normally completed in a time ranging from a few seconds up to some ten minute, but preferably within a few minutes.

Satisfactory reduction is achieved within this range of conditions if a light-sensitive material for photomechanical process of the present invention is used.

The reducing bath acts on the silver image having been formed in the emulsion layer via the uppermost light-insensitive layers.

In practice, reduction is achieved in various ways. Thus, for example, the light-sensitive material for photomechanical process can be dipped into the reducing bath while liquid is agitated, or the reducing bath can be applied to the surface of the light-sensitive material for photomechanical process by means of a brush or a roller.

The invention is described in more detail below by means of non-limiting illustrative examples.

The molecular weight of the water insoluble and organic solvent soluble polymers according to the present invention used in the following examples was 30,000±2,000.

COMPARATIVE EXAMPLE 1

An aqueous solution of silver nitrate and an aqueous solution of sodium chloride were mixed simultaneously in the presence of $5.0\times10^{-6}$ mol per mol of silver of $(NH_4)_3RhCl_6$ with an aqueous gelatin solution maintained at 40° C., after which the soluble salts were removed using a method well-known in the industry. Gelatin was then added and 2-methyl-4-hydroxy-1,3,3*a*,7-tetraazaindene was added as a stabilizer without chemical ripening. The resulting emulsion comprised mono-dispersed grains having a cubic crystalline form of average grain size 0.15 μm.

The hydrazine derivative illustrative compound (2) in an amount of 31 mg/m$^2$ (as a methanol solution of 2 wt/vol % hydrazine derivative), the mercaptotetrazole derivative in an amount of 2.6 mg/m$^2$ indicated below, and poly(ethyl acrylate) latex in an amount of 30 wt % with respect to gelatin in terms of solid fraction were added to the emulsion. 1,3-Vinylsulfonyl-2-propanol was then added as a hardening agent, and the emulsion was coated onto a polyester support to provide a coated silver weight of 3.8 g/m$^2$. The gelatin as contained in the emulsion was coated in an amount of 1.8 g/m$^2$.

Mercaptotetrazole Derivative

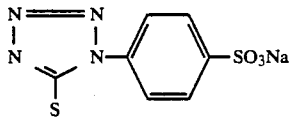

A protective layer containing 1.5 g/m$^2$ of gelatin, the surfactants indicated below as coating promotors, and the stabilizer and the matting agents indicated below, were coated over the emulsion layer and dried to provide a protective layer.

| | |
|---|---|
| Surfactants | |
| 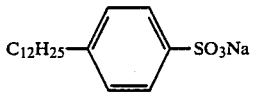 | 37 mg/m$^2$ |
| $CH_2COOC_6H_{13}$<br>\|<br>$CH_2COOC_6H_{13}$<br>\|<br>$SO_3Na$ | 37 mg/m$^2$ |
| $C_8F_{17}SO_2N(C_3H_7)CH_2COOK$ | 2.5 mg/m$^2$ |
| Stabilizer | |
| Thioctic acid | 2.1 mg/m$^2$ |
| Matting Agents | |
| Poly(methyl methacrylate) (average particle size 2.5 μm) | 9.0 mg/m$^2$ |
| Silica (average particle size 4.0 μm) | 9.0 mg/m$^2$ |

EXAMPLE 1

Preparation of Polymer Particles Containing a Hydrazine Derivative

A solution consisting of 3.0 grams of hydrazine derivative illustrative compound (1), 6.0 grams of polymer illustrative example (P-57) and 50 ml of ethyl acetate was heated to 60° C., after which 120 ml of an aqueous solution containing 12 grams of gelatin and 0.7 gram of sodium dodecylbenzenesulfonate was added to obtain a fine particle emulsified dispersion using a high speed agitator (a homogenizer, made by Nippon Seiki Seisakusho). The ethyl acetate was removed from the emulsion using a rotary evaporator (with stirring under a reduced pressure of about 400 torr at 60° C., for a period of 1 hour).

Sample Preparation

Samples 1-1 to 1-4 were prepared in the same way as in Comparative Example 1 except for the type and amount of the hydrazine derivative employed therein. On the other hand, Samples 1-5 to 1-8 were prepared in the same way as Comparative Example 1 except that the type and amount of the hydrazine derivative in Comparative Example 1 were substituted with an emulsified dispersion as described in "Preparation of Polymer Particles Containing a Hydrazine Derivative" above.

Sample 1-9 was prepared in the same way as Sample 1-5 except that a high boiling point organic solvent was used in place of the polymer in Sample 1-5. The types and amounts of the hydrazine derivatives, polymers, and the high boiling point organic solvent employed are shown in Table 1.

The coated samples mentioned above were coated under two conditions as indicated below.

Condition 1

The samples were coated within 1 hour after adding the additives to the coating liquid for the photographic emulsion layer.

Condition 2

The coating liquid was prepared but without the film hardening agent and the poly(ethylene acrylate) latex and then aged at 40° C. for 24 hours. After aging, the film hardening agent and the poly(ethylene acrylate) latex were then added and as the samples were immediately coated.

The samples thus prepared were exposed through an optical wedge using a Dainippon Screen Co. Model P-617DQ printer (light source: 100 V 1 kw quartz halogen lamp) and developed for 20 seconds at 38° C. using development bath (I) having the composition indicated below and then fixed by using GR-F1 (made by Fuji Photo Film Co., Ltd.) for 20 seconds, water washed for 20 seconds and dried sequentially in an FG-660F automatic processor made by Fuji Photo Film Co., Ltd.

| Development Bath Formula (I) | |
|---|---|
| Hydroquinone | 50.0 g |
| N-methyl-p-aminophenol hemi-sulfate | 0.3 g |
| Sodium hydroxide | 18.0 g |
| 5-Sulfosalicylic acid | 55.0 g |
| Potassium sulfite | 110.0 g |
| Ethylenediamine tetraacetic acid, di-sodium salt | 1.0 g |
| Potassium bromide | 10.0 g |
| 5-Methylbenzotriazole | 0.4 g |
| 2-Mercaptobenzimidazole-5-sulfonic acid | 0.3 g |
| 3-(5-mercaptotetrazole)benzenesulfonic acid, sodium salt | 0.2 g |
| N-n-Butyldiethanolamine | 15.0 g |
| Sodium toluenesulfonate | 8.0 g |
| Water to make | 1 liter |
| Adjusted (with KOH) to pH | 11.6 |

TABLE 1

| Sample No. | Additives: Hydrazine Derivative | Additives: Amount (mg/m$^2$) | Additives: Polymer etc. | Additives: Amount (mg/m$^2$) | Filtering Time for the Coating Liquid (Note 2): Cond. 1 (sec) | Filtering Time: Cond. 2 (sec) | Photographic Properties (Note 3): S Cond. 1 | S Cond. 2 | ΔS Cond. 1 | ΔS Cond. 2 | Remarks |
|---|---|---|---|---|---|---|---|---|---|---|---|
| 1-1 | Compound (1) | 53 | — | | 21 | NG (Note 4) | 100 | 85 | 15 | | Comparative Example |
| 1-2 | Compound (5) | 71 | — | — | 23 | NG | 103 | 86 | 17 | | Comparative Example |
| 1-3 | Compound (6) | 51 | — | — | 20 | NG | 83 | 75 | 12 | | Comparative Example |

TABLE 1-continued

| Sample No. | Additives: Hydrazine Derivative | Amount (mg/m²) | Polymer etc. | Amount (mg/m²) | Filtering Time for the Coating Liquid (Note 2): Cond. 1 (sec) | Cond. 2 (sec) | Photographic Properties (Note 3): S Cond. 1 | S Cond. 2 | ΔS Cond. 1 | ΔS Cond. 2 | Remarks |
|---|---|---|---|---|---|---|---|---|---|---|---|
| 1-4 | Compound (14) | 71 | — | — | 22 | NG | 105 | 88 | 17 | | Comparative Example |
| 1-5 | Compound (1) | 53 | Compound P-57 | 100 | 12 | 18 | 99 | 93 | 6 | | This Invention |
| 1-6 | Compound (5) | 71 | Compound P-57 | 140 | 15 | 20 | 100 | 95 | 5 | | This Invention |
| 1-7 | Compound (6) | 51 | Compound P-57 | 100 | 12 | 17 | 84 | 80 | 4 | | This Invention |
| 1-8 | Compound (14) | 71 | Compound P-57 | 140 | 13 | 19 | 104 | 98 | 6 | | This Invention |
| 1-9 | Compound (1) | 53 | TCHP (Note 1) | 100 | 16 | 90 | 75 | 62 | 13 | | Comparative Example |

Note 1: TCHP: Tricyclohexyl phosphate (high boiling organic solvent)
Note 2: Coating Liquid Filtration Time: The time required to filter 100 ml of coating liquid under a pressure of 1 pound per square inch through a 1.2 cm diameter microfilter of average pore diameter 10 μm.
Note 3: The photographic property S indicates the relative value of the reciprocal of the exposure required to provide a density of 3.0 (i.e. the relative speed).
Note 4: The term "NG" indicates that filter blockage occurred and it was only possible to filter part of the 100 ml quantity.

It is clear from the results shown in Table 1 that precipitation occurred on aging of the coating liquid of Samples 1-1 to 1-4 and that filter blockage occurred such that filtration was impossible. On the other hand, there was hardly any filter blockage at all with Samples 1-5 to 1-8 of the present invention. Furthermore, a long period of time was required for the filtration of the full amount of liquid in the case of Sample 1-9 wherein a high boiling point organic solvent had been used.

In terms of photographic properties, the samples of the present invention exhibited no loss of speed when coated without aging (Condition 1) in comparison to that observed with Samples 1-1 to 1-4 in which polymers had not been used, and the change in performance was clearly small even after aging (condition 2). Furthermore, in the case of Sample 1-9 in which a high boiling point organic solvent was used, it was impossible to obtain an adequate speed even on coating without aging (Condition 1) and there was a pronounced loss of speed on coating after aging of the coating liquid.

As described above, the samples of the present invention are clearly suitable for the manufacture of photosensitive materials, the coating liquid itself being stable with little variation in the photographic performance even when the coating liquid is aged over a long period of time.

EXAMPLE 2

Samples were prepared in the same way as Sample 1-5 in Example 1 except for using the polymers indicated in Table 2. The filtering properties of the coating liquid and the photographic properties were measured in the same way as in Example 1.

It is clear from Table 2 that the samples of the present invention exhibited little filter blockage and little change in photographic properties upon aging of the coating liquid, and that the stability under manufacturing conditions (i.e., storage of coating liquid) was very good.

TABLE 2

| Sample No. | Type of Polymer | Filtering Time* (sec.) | Photographic Properties** ΔS | Remarks |
|---|---|---|---|---|
| 2-1 | — | NG | 16 | Comparative Example |
| 2-2 | Compound P-3 (100 mg/m²) | 19 | 5 | This Invention |
| 2-3 | Compound P-27 " | 21 | 4 | This Invention |
| 2-4 | Compound P-33 " | 20 | 5 | This Invention |
| 2-5 | Compound P-56 " | 23 | 6 | This Invention |
| 2-6 | Compound P-64 " | 24 | 6 | This Invention |
| 2-7 | Compound P-115 " | 22 | 5 | This Invention |
| 2-8 | Compound P-171 " | 22 | 6 | This Invention |

*Filtering Time: Filtering time under Condition 2 in Example 1.
**Photographic Properties ΔS: This has the same significance as ΔS in Example 1.

EXAMPLE 3

Sample Preparation

An aqueous solution of silver nitrate and aqueous solutions of potassium iodide and potassium bromide were all added simultaneously over a period of 60 minutes in the presence of ammonia and potassium hexachloro iridate (III) at a concentration of $4\times10^{-7}$ mol per mol of silver to an aqueous gelatin solution maintained at 50° C. By maintaining a pAg value of 7.8 during the addition, a cubic, monodispersed emulsion of average grain size 0.25 μm and of average silver iodide content 1 mol % was obtained. Next, 5,5'-dichloro-9-ethyl-3,3'-bis(3-sulfopropyl)oxacarbocyanine sodium salt as a sensitizing dye, 4-hydroxy-6-methyl-1,3,3*a*,7-tetraazaindene as stabilizer, a dispersion of poly(ethyl acrylate), polyethyleneglycol, 1,3-vinylsulfonyl-2-propanol, hydrazine derivative (as a 2 wt/vol % methanol solution), namely the aforementioned illustrative compound (13) (20 mg/m²) were added to the emulsion prepared in this way. The resulting liquid was coated on a polyethyleneterephthalate support in such a way as to provide a coated silver weight of 3.4 g/m² designated Sample 3-1.

Samples 3-2 to 3-10 were then prepared in the same way as Sample 3-1 except that emulsified dispersions prepared in the manner outlined under "Preparation of Polymer Particles Containing a Hydrazine Derivative" in Example 1 using the hydrazine derivative of Sample 3-1. The type of polymer used in each sample is shown in Table 3.

The above mentioned samples were coated under the same two conditions as in Example 1.

These samples were exposed through an optical wedge using tungsten light of color temperature 3200° K. and then developed for 30 seconds at 34° C. in the development bath used in Example 1, and fixed, washed with water and dried in the same way as Example 1.

TABLE 3

| Sample No. | Type of Polymer | | Filtering Time* (sec.) | Photographic Properties** ΔS | Remarks |
|---|---|---|---|---|---|
| 3-1 | — | | NG | 12 | Comparative Example |
| 3-2 | Compound P-39 | (40 mg/m²) | 20 | 4 | This Invention |
| 3-3 | Compound P-40 | " | 18 | 5 | This Invention |
| 3-4 | Compound P-56 | " | 19 | 4 | This Invention |
| 3-5 | Compound P-59 | " | 20 | 5 | This Invention |
| 3-6 | Compound P-61 | " | 21 | 5 | This Invention |
| 3-7 | Compound P-70 | " | 23 | 6 | This Invention |
| 3-8 | Compound P-115 | " | 20 | 5 | This Invention |
| 3-9 | Compound P-117 | " | 19 | 4 | This Invention |
| 3-10 | Compound P-168 | " | 19 | 4 | This Invention |

*Filtering Time: Filtering time under condition 2 in Example 1.
**Photographic Properties ΔS: This has the same significance as ΔS in Example 1.

It is clear from the results shown in Table 3 that none of the samples of the present invention caused filter blockage, that the change in photographic properties was slight, and that even when silver halides with different halogen compositions were used, the manufacturing stability was very good.

Furthermore, when samples were prepared in the same way as in this example except that the hydrazine derivative used in was substituted with the compound used in Example 1, the samples having emulsified dispersions of the present invention prepared with polymer particles containing the hydrazine derivative exhibited good filtering properties. Even after aging the coating liquid for a 24 hours at 40° C. of time, there was little change in photographic properties and good results were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one hydrophilic colloid layer containing gelatin, said hydrophilic colloid layer comprising polymer particles which contain a hydrazine derivative, said hydrazine derivative being contained in the polymer particles by dissolving the hydrazine derivative and the polymer in a water insoluble low boiling point organic solvent and emulsifying and dispersing the resulting solution in a gelatin aqueous solution, wherein said polymer contains no acid groups.

2. A silver halide photographic material as in claim 1, wherein said hydrazine derivative is hydrophobic.

3. A silver halide photographic material as in claim 1, wherein said hydrazine derivative is represented by formula (I):

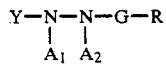

(I)

wherein Y represents an aliphatic group, an aromatic group Or a heterocyclic group, $A_1$ and $A_2$ each represents a hydrogen atom or one of $A_1$ and $A_2$ represents a hydrogen atom while the other represents a sulfinic acid residue or a

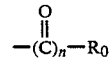

group wherein $R_0$ represents an alkyl group, an alkenyl group, an aryl group, an alkoxy group or an aryloxy group, and n represents an integer having a value of 1 or 2; R represents a hydrogen atom, an alkyl group, an aryl group, an alkoxy group, an aryloxy group, an amino group, an alkoxycarbonyl group, an aryloxycarbonyl group, a carbamoyl group, an azo group or a heterocyclic group; and G represents a carbonyl group, a sulfonyl group, a sulfoxy group,

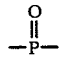

group, or an iminomethylene group.

4. A silver halide photographic material as in claim 1, wherein said polymer is a water insoluble and organic solvent soluble polymer.

5. A silver halide photographic material as in claim 4, wherein said polymer is selected from the group consisting of vinyl polymers, polyesters, polyamides, polyurethanes and cellulose derivatives, or combinations thereof.

6. A silver halide photographic material as in claim 4, wherein from 30 40 70 wt % of the components of said water insoluble and organic solvent soluble polymer have a molecular weight below 40,000.

7. A silver halide photographic material as in claim 1, wherein the particle size of said polymer is from 0.04 μm to 0.4 μm.

8. A silver halide photographic material as in claim 1, wherein said low boiling point organic solvent is selected from the group consisting of ethyl acetate, butyl acetate, ethyl propionate, secondary butyl alcohol, methyl ethyl ketone methylisobutyl ketone β-ethoxyehtyl acetate, methylcellosolve acetate and cyclohexanone.

* * * * *